US006228549B1

(12) United States Patent
Lambert et al.

(10) Patent No.: US 6,228,549 B1
(45) Date of Patent: May 8, 2001

(54) MAGNETIC CARRIER PARTICLES

(75) Inventors: Patrick M. Lambert; William K. Goebel, both of Rochester, NY (US)

(73) Assignee: Heidelberg Digital L.L.C., Rochester, NY (US)

( * ) Notice: Subject to any disclaimer, the term of this patent is extended or adjusted under 35 U.S.C. 154(b) by 0 days.

(21) Appl. No.: 09/572,989

(22) Filed: May 17, 2000

(51) Int. Cl.[7] ..... G03G 9/107
(52) U.S. Cl. ..... 430/106.6; 430/108; 430/137
(58) Field of Search ..... 430/106.6, 108, 430/137

(56) References Cited

U.S. PATENT DOCUMENTS

| | | | |
|---|---|---|---|
| 3,716,630 | 2/1973 | Shirk | 423/594 |
| 3,795,617 | 3/1974 | McCabe | 252/62.1 |
| 3,795,618 | 3/1974 | Kasper | 252/62.1 |
| 3,893,935 | 7/1975 | Jadwin et al. | 252/62.1 |
| 3,938,992 | 2/1976 | Jadwin et al. | 96/1 SD |
| 3,941,898 | 3/1976 | Sadamatsu et al. | 427/18 |
| 4,042,518 | 8/1977 | Jones | 252/62.6 |
| 4,076,857 | 2/1978 | Kasper et al. | 427/18 |
| 4,206,064 | 6/1980 | Kiuchi et al. | 430/106 |
| 4,385,823 | 5/1983 | Kasper et al. | 355/3 R |
| 4,473,029 | 9/1984 | Fritz et al. | 118/657 |
| 4,496,643 | 1/1985 | Wilson et al. | 430/110 |
| 4,531,832 | 7/1985 | Kroll et al. | 355/3 DD |
| 4,546,060 | 10/1985 | Miskinis et al. | 430/108 |
| 4,623,603 | 11/1986 | Iimura et al. | 430/108 |
| 4,764,445 | 8/1988 | Miskinis et al. | 430/108 |
| 4,833,060 | 5/1989 | Nair et al. | 430/137 |
| 4,855,205 | 8/1989 | Saha et al. | 430/106.6 |
| 4,855,206 | 8/1989 | Saha | 430/106.6 |
| 5,061,586 | 10/1991 | Saha et al. | 430/108 |
| 5,104,761 | 4/1992 | Saha et al. | 430/106.6 |
| 5,106,714 | 4/1992 | Saha et al. | 430/106.6 |
| 5,190,841 | 3/1993 | Saha et al. | 430/106.6 |
| 5,190,842 | 3/1993 | Saha et al. | 430/106.6 |
| 5,212,038 | 5/1993 | Watanabe et al. | 430/122 |
| 5,256,513 | 10/1993 | Kawamura et al. | 430/106.6 |
| 5,268,249 | 12/1993 | Saha et al. | 430/106.6 |
| 5,306,592 | 4/1994 | Saha | 430/137 |
| 5,318,873 | 6/1994 | Kawamura et al. | 430/122 |
| 5,332,645 | 7/1994 | Saha et al. | 430/137 |
| 5,376,492 | 12/1994 | Stelter et al. | 430/122 |
| 5,424,160 | 6/1995 | Smith et al. | 430/108 |
| 5,496,674 | 3/1996 | Adel et al. | 430/106.6 |
| 5,500,320 | 3/1996 | Saha | 430/106.6 |
| 5,512,403 | 4/1996 | Tyagi et al. | 430/106.6 |
| 5,512,404 * | 4/1996 | Saha | 430/108 |
| 5,515,404 | 5/1996 | Pearce | 376/371 |
| 5,532,096 | 7/1996 | Maruta et al. | 430/108 |
| 5,614,346 | 3/1997 | Adel et al. | 430/106.6 |
| 5,705,221 * | 1/1998 | Yoerger | 430/108 |
| 5,710,965 | 1/1998 | Nozawa et al. | 399/313 |
| 5,737,677 | 4/1998 | Tombs et al. | 399/296 |
| 5,795,692 | 8/1998 | Lewis | 430/106.6 |
| 5,998,076 | 12/1999 | Mahabadi et al. | 430/106.6 |
| 6,040,103 | 3/2000 | Ohno et al. | 430/110 |

FOREIGN PATENT DOCUMENTS

| | | | |
|---|---|---|---|
| 0 003 905 A1 | 9/1979 | (EP) | C08J/3/02 |
| 0 086 445 A1 | 8/1983 | (EP) | H01F/1/36 |
| 1 501 065 | 2/1978 | (GB) | G03G/9/08 |

OTHER PUBLICATIONS

"Magnetic Materials", B. D. Cullity, published by Addison–Wesley Pub. Co. 1972, p. 18–23.

"Spray Drying", by k. Masters, published by Leonard Hill Books, London, p. 502–509.

"Ferromagnetic Materials", Val. 3, edited by E. P. Wohlfarth, published by North–Halland Pat. Co. Amsterdan p. 315 et seq.

Research Disclsoure No. 21030, vol. 210, Oct. 1981 (published by Industrial opportunities Ltd., Homewell, Havant, Hampshire, P09 1EF, United Kingdom).

U. S. Patent Application 09/572988 filed May 17, 2000.

U.S. Provisional Patent Application 60/204,941 filed May 17, 2000.

* cited by examiner

*Primary Examiner*—John Goodrow
(74) *Attorney, Agent, or Firm*—John L. Wood

(57) ABSTRACT

Conductive hard magnetic carrier particles are disclosed which are useful for development of electrostatic latent images. The carrier particles comprise a core of a hard magnetic material, preferably a hard magnetic ferrite such as strontium ferrite, which has a metal oxide composition disposed on the outer surface of the core. The metal oxide composition comprises a layer of an oxide of at least one metal, and in some embodiments, the metal oxide composition may be represented by the formula $MO_{n/2}$ where M is at least one multi-valent metal represented by $M^{n+}$ where n is an integer of at least 4. Also disclosed are carrier particles having the foregoing structure wherein the outer surface of the core further defines a transition zone which extends into the core of hard magnetic ferrite, wherein the ferrite crystal structure within the transition zone is doped with multi-valent metal ions of the formula $M^{n+}$, where n is an integer of at least 4. The carrier particles may be used in making single- and two-component developers for use development of electrostatic latent image patterns in an electrographic process. Also disclosed are methods for using such carrier particles in an electrographic process such that the speed and imaging of the process is improved.

42 Claims, 1 Drawing Sheet

MAGNETIC CARRIER PARTICLES

CROSS REFERENCE TO RELATED APPLICATIONS

Attention is directed to application U.S. Ser. No. 09/572,988 pending filed concurrently herewith on May 17, 2000 entitled "MAGNETIC CARRIER PARTICLES"; and U.S. Ser. No. 60/204,941 also filed on May 17, 2000 entitled "METHODS FOR USING HARD MAGNETIC CARRIERS IN AN ELECTROGRAPHIC PROCESS", the disclosures of which are incorporated herein by reference in their entirety.

BACKGROUND OF THE INVENTION

This invention relates to electrography and more particularly it relates to magnetic carrier particles and developers for the dry development of electrostatic charge images.

In electrography, an electrostatic charge image is formed on a dielectric surface, typically the surface of the photoconductive recording element. Development of this image is typically achieved by contacting it with a two-component developer comprising a mixture of pigmented resinous particles, known as toner, and magnetically attractable particles, known as carrier. The carrier particles serve as sites against which the non-magnetic toner particles can impinge and thereby acquire a triboelectric charge opposite to that of the electrostatic image. During contact between the electrostatic image and the developer mixture, the toner particles are stripped from the carrier particles to which they had formerly adhered (via triboelectric forces) by the relatively strong electrostatic forces associated with the charge image. In this manner, the toner particles are deposited on the electrostatic image to render it visible.

It is generally known to apply developer compositions of the above type to electrostatic images by means of a magnetic applicator which comprises a cylindrical sleeve of non-magnetic material having a magnetic core positioned within. The core usually comprises a plurality of parallel magnetic strips which are arranged around the core surface to present alternating north and south oriented magnetic fields. These fields project radially, through the sleeve, and serve to attract the developer composition to the sleeve outer surface to form what is commonly referred to in the art as a "brushed nap". Either or both of the cylindrical sleeve and the magnetic core are rotated with respect to each other to cause the developer to advance from a supply sump to a position in which it contacts the electrostatic image to be developed. After development, the toner depleted carrier particles are returned to the sump for toner replenishment.

Conventionally, carrier particles made of soft magnetic materials have been employed to carry and deliver the toner particles to the electrostatic image. U.S. Pat. Nos. 4,546,060, 4,473,029 and 5,376,492, the teachings of which are incorporated herein by reference in their entirety, teach the use of hard magnetic materials as carrier particles and also apparatus for the development of electrostatic images utilizing such hard magnetic carrier particles. These patents require that the carrier particles comprise a hard magnetic material exhibiting a coercivity of at least 300 Oersteds when magnetically saturated and an induced magnetic moment of at least 20 EMU/gm when in an applied magnetic field of 1000 Oersteds. The terms "hard" and "soft" when referring to magnetic materials have the generally accepted meaning as indicated on page 18 of Introduction To Magnetic Materials by B. D. Cullity published by Addison-Wesley Publishing Company, 1972. These hard magnetic carrier materials represent a great advance over the use of soft magnetic carrier materials in that the speed of development is remarkably increased with good image development. Speeds as high as four times the maximum speed utilized in the use of soft magnetic carrier particles have been demonstrated.

In the methods taught by the foregoing patents, the developer is moved at essentially the same speed and direction as the electrostatic image to be developed by high speed rotation of the multi-pole magnetic core within the sleeve, with the developer being disposed on the outer surface of the sleeve. Rapid pole transitions on the sleeve are mechanically resisted by the carrier because of its high coercivity. The brushed nap, also called "strings" or "chains", of the carrier (with toner particles disposed on the surface of the carrier particles), rapidly "flip" on the sleeve in order to align themselves with the magnetic field reversals imposed by the rotating magnetic core, and as a result, move with the toner on the sleeve through the development zone in contact with or close relation to the electrostatic image on a photoconductor. See also, U.S. Pat. No. 4,531,832, the teachings of which are also incorporated herein in their entirety, for further discussion concerning such a process.

The rapid pole transitions, for example as many as 600 per second on the sleeve surface when the magnetic core is rotated at a speed of 2000 revolutions per minute (rpm), create a highly energetic and vigorous movement of developer as it moves through the development zone. This vigorous action constantly recirculates the toner to the sleeve surface and then back to the outside of the nap to provide toner for development. This flipping action also results in a continuous feed of fresh toner particles to the image. As described in the above-described patents, this method provides high density, high quality images at relatively high development speeds.

The above-mentioned U.S. patents, while generic to all hard magnetic materials having the properties set forth therein, prefer the hard magnetic ferrites which are compounds of barium and/or strontium, such as, $BaFe_{12}O_{19}$, $SrFe_{12}O_{19}$ and the magnetic ferrites having the formula $MO.6Fe_2O_3$, where M is barium, strontium or lead as disclosed in U.S. Pat. No. 3,716,630. While these hard ferrite carrier materials represent a substantial increase in the speed with which development can be conducted in an electrostatographic apparatus, many users of such equipment seek even faster development speeds and so further improvements to the carrier and development process are of interest. U.S. Pat. No. 4,764,445 discloses hard magnetic ferrite carrier particles for electrographic developing applications which contain from about 1 to about 5 percent by weight of lanthanum. As mentioned in this patent, the speed of development in an electrographic process using conventional hard magnetic ferrite materials, while higher than methods using other techniques, such as with soft magnetic carriers, is limited by the resistivity of such ferrite materials. The patent discloses that addition of lanthanum to the hard magnetic ferrite crystal structure in the disclosed amounts results in a more conductive magnetic ferrite particle, yielding greater development efficiency and/or speed of development.

Others have also proposed methods for making conductive carrier particles. For example, U.S. Pat. No. 4,855,206 discloses adding neodymium, praseodymium, samarium, europium, or mixtures thereof, or a mixture of one or more of such elements and lanthanum, to a hard magnetic ferrite material to increase conductivity. U.S. Pat. No. 5,795,692 discloses a conductive carrier composition having a magnetic oxide core which is said to be coated with a layer of zinc metal that is the reaction product of zinc vapor and the magnetic oxide.

Other carriers proposed for use in an electrographic process include multi-phase ferrite composites as taught in U.S. Pat. Nos. 4,855,205; 5,061,586; 5,104,761; 5,106,714; 5,190,841; and 5,190,842.

U.S. Pat. No. 5,532,096 discloses a carrier which has been coated on the surface thereof with a layer obtained by curing a partially hydrolyzed sol obtained from at least one alkoxide selected from the group consisting of silicon alkoxides, titanium alkoxides, aluminum alkoxides, and zirconium alkoxides. The disclosed carriers coated with such layer are said to be more durable in comparison to carriers coated with conventional resin coatings, such as those prepared using silicone, acrylic and styrene-acrylic resins.

U.S. Pat. No. 5,268,249 discloses magnetic carrier particles with a single-phase, W-type hexagonal crystal structure of the formula $MFe_{16}Me_2O_{27}$ where M is strontium or barium and Me is a divalent transition metal selected from nickel, cobalt, copper, zinc, manganese, magnesium, or iron.

While some carriers may have increased conductivity relative to traditional hard magnetic ferrite materials previously employed in development of electrostatic images, in many instances the conductivity of the carrier is so great that imaging problems are created due to carrier being deposited in the image. Although not clear, it is believed that certain levels of conductivity in the carrier can facilitate a flow of electrical charge between the carrier on the nap and the shell, thereby inducing a charge reversal on the carrier and allowing the carrier particles to electrostatically deposit in the image, referred to hereinafter as "image carrier pickup" or "I-CPU". The presence of I-CPU can impact color rendition and image quality.

As can be seen, it would be desirable to develop new carriers that can be used in an electrographic process for the development of latent electrostatic images. It would also be desirable to develop carriers that can exhibit an greater level of conductivity relative to traditional magnetic ferrite materials previously employed in such processes, which would provide not only higher development efficiency, but also preferably reduced levels of I-CPU.

SUMMARY OF THE INVENTION

The foregoing objects and advantages are realized by the present invention, which, in one aspect, concerns carrier particles for use in the development of electrostatic latent images which comprise particles having a core of a hard magnetic material. The core has an outer surface with a conductive metal oxide composition thereon comprising an oxide of at least one metal.

In another aspect, the invention relates to a carrier for use in the development of electrostatic latent images that comprise particles having a core of a hard magnetic ferrite material with a single-phase, hexagonal crystal structure. The core has an outer surface with a metal oxide composition disposed thereon represented by the formula $MO_{n/2}$, wherein M is at least one multi-valent metal represented by $M^{n+}$ with n being an integer of at least 4. The outer surface of the core further defines a transition zone within the hexagonal crystal structure which extends from the outer surface and into the hard magnetic ferrite material of the core, where the hexagonal crystal structure of the hard magnetic ferrite material within the transition zone is doped with metal ions of the at least one multi-valent metal ion of formula $M^{n+}$.

The invention further contemplates a two-component electrographic developer suitable for high speed copying applications which comprises charged toner particles and oppositely charged carrier particles as described hereinabove.

In another aspect, the invention concerns a single-component developer comprising the hard magnetic carrier material described hereinabove.

In another aspect, the invention also concerns methods of developing electrostatic images on a photoconductive surface by utilizing the foregoing two-component or single-component developers.

The invention also relates to a method for preparing the carrier materials previously described. Initially, a particulate core material comprised of particles of a hard magnetic material is provided. The core particles are then admixed with a solution comprising a solvent and at least one metal oxide precursor compound. The admixture is then heated to remove the solvent therefrom and thereby coat the at least one metal oxide precursor compound onto the surface of the particles of the hard magnetic material. Finally, the so-coated particles are fired, i.e., calcined, in an oxidizing atmosphere at a temperature sufficient to form a conductive metal oxide composition on the outer surface of the core particles by thermal degradation of the metal oxide precursor compound and reaction with the hard magnetic material. The conductive metal oxide composition formed on the core particles comprises an oxide of the at least one metal.

DETAILED DESCRIPTION OF THE INVENTION

Figure 1:
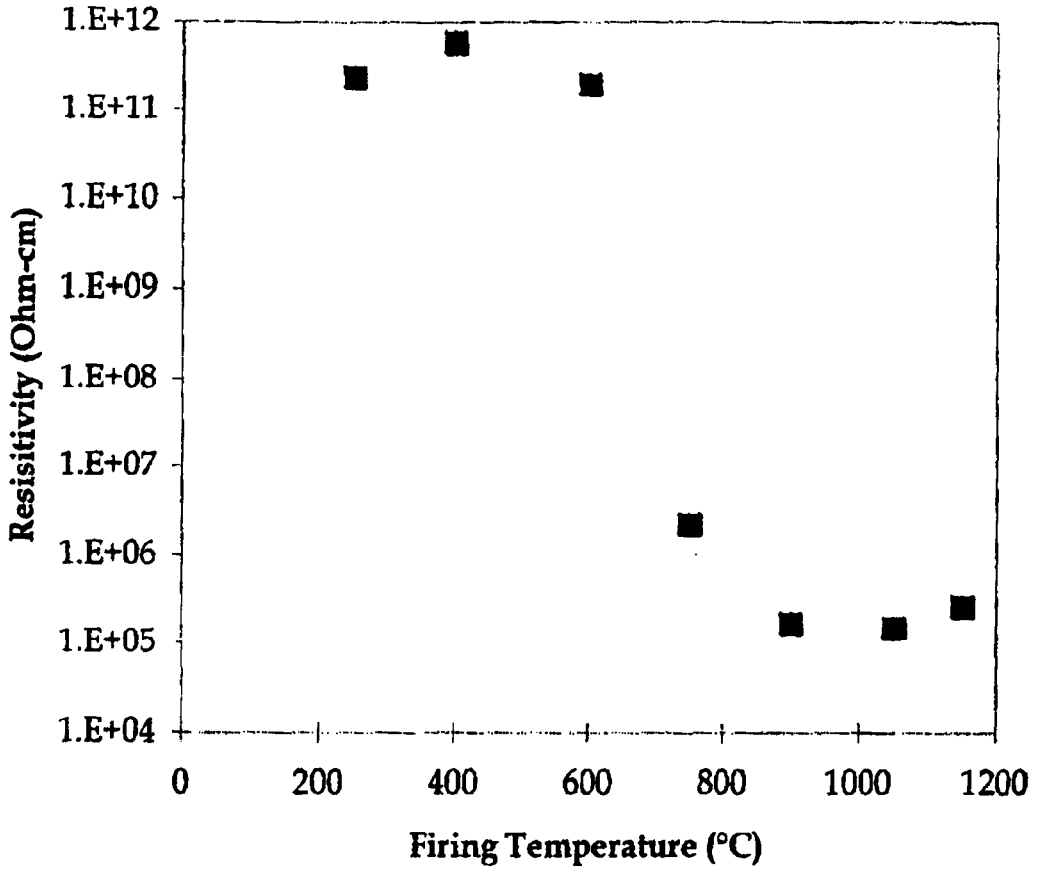
FIG. 1 is a graph of carrier resistivity (in ohm-cm) versus firing temperature (in ° C), and is discussed in more detail in Examples 1–7 hereinbelow.

As previously pointed out in connection with U.S. Pat. Nos. 4,546,060 and 4,473,029, the disclosures of which have been incorporated herein by reference, the use of "hard" magnetic materials as carrier particles increases the speed of development dramatically when compared with carrier particles made of "soft" magnetic particles. The preferred ferrite materials disclosed in these patents include barium, strontium and lead ferrites having the formula $MO.6Fe_2O_3$ wherein M is barium, strontium or lead. A preferred ferrite is strontium ferrite. These materials preferably have a single-phase, hexagonal crystal structure. While the speed with which development can be carried out is much higher than prior techniques, they are limited by the resistivity of the above described ferrite materials which have the necessary magnetic properties for carrying out the development method. It is generally known that the resistivity of the carrier particles bears a direct result on the speed of development that can be employed.

While development speed is generally referred to in the art, a more meaningful term is to speak of "development efficiency". In a magnetic brush development system, development efficiency is defined as the potential difference between the photoreceptor in developed image areas before and after development divided by the potential difference between the photoreceptor and the brush prior to development times 100. For example, in a charged area development system, if the photoreceptor film voltage is −250 volts and the magnetic brush is −50 volts the potential difference is −200 volts prior to development. If, during development, the film voltage is reduced by 100 volts to −150 volts in image areas by the deposition of positively charged toner particles, the development efficiency is (−100 volts divided by −200 volts) times 100, which gives an efficiency of development of 50 percent. It can be readily seen that as the efficiency of the developer material increases the various parameters employed in the electrostatographic method can be altered in accordance therewith. For example, as the efficiency increases the voltage differential prior to development can be reduced in order to deposit the same amount of toner in image areas as was previously done at the lower efficiency. The same is true with regard to the exposure energy level employed to impart the latent electrostatic image on the photoreceptor film. The speed of the development step of the procedure can be increased as the efficiency increases in that as the efficiency increases more toner can be deposited under the same conditions in a shorter period of time. Thus, higher development efficiency permits the reoptimization of the various parameters employed in the electrostatic process thereby resulting in savings in both energy and time.

As previously mentioned the efficiency of development when employing ferrite carriers is limited by the resistivity of the ferrite materials themselves. For example, because these materials have a resistivity of approximately $1\times10^{11}$ ohm-cm, therefore, the highest efficiency theoretically achievable is approximately 50 percent. However, in order to obtain high quality copies of the original image, it is necessary to maintain high magnetic properties; i.e. a coercivity of at least about 300 Oersteds when magnetically saturated and an induced magnetic moment of at least about 20 EMU/gm when in an applied field of 1000 Oersteds while at the same time increasing the conductivity of the particles.

The present invention contemplates a carrier comprising a core of a hard magnetic material, preferably a hard magnetic ferrite, that has a conductive metal oxide composition deposited thereon and reacted with the hard magnetic material so as to reduce the overall resistivity of the carrier, while still maintaining the desirable magnetic properties of the hard magnetic material. The composition is deposited onto the core in either a continuous or discontinuous form.

In preferred embodiments, the outer surface of the hard magnetic core defines a transition zone which extends into the magnetic core, i.e., the transition zone is an area within the hard magnetic material near the outer surface of the core. For example, in the event the core is a particle that is spherical or nearly spherical in shape, the transition zone may be visualized as a shell whose outer surface coincides with the outer surface of the particle. Within the transition zone, the hard magnetic material's crystal structure preferably comprises a gradient of metal ions corresponding to the formula $M^{n+}$, where M and n are as previously defined for the metal oxide composition disposed on the core, which metal ions are substituted into the hard magnetic material's crystalline lattice. By "gradient" it is meant that the metal ion concentration is greatest near the outer surface of the core, and such concentration within the crystal lattice decreases at levels deeper within the core. While not wishing to be bound by theory, it is believed, from size and charge considerations of the $M^{n+}$ cations disclosed herein, that the resistivity of a hard magnetic ferrite can be decreased by substitution of the above-described multi-valent metal ions into the iron lattices of the hexagonal ferrite crystal structure, rather than by replacement of $Sr^{2+}$ $Ba^{2+}$, or $Pb^{2+}$. In doing so, the $M^{n+}$ multi-valent metal ion substituents as described hereinabove force a charge compensation in the ferric ($Fe^{3+}$) lattice; i.e., ferrous ($Fe^{2+}$) cations form. The $Fe^{2+}/Fe^{3+}$ charge couple thereby created provides a semi-conductive electronic pathway, resulting in ferrite compositions of higher conductivity. As a result, the conductive metal oxide compositions of the present invention are generally tightly adherent to the core particle, and do not easily flake or spall off when used in an electrographic process.

Thus, by placing the metal oxide composition onto the core as described above, the resistivity of hard magnetic carrier material can be reduced from approximately $1\times10^{11}$ ohm-cm by at least about one order of magnitude, i.e. to approximately $1\times10^{10}$ ohm-cm. By use of the term "conductive" in reference to the carrier and/or its metal oxide composition, it is meant that placing such composition on the core can result in a reduction of the carrier's resistivity of at least about one order of magnitude as mentioned above relative to a carrier of the hard magnetic material without said composition being disposed thereon.

Preferably the resistivity of the carrier is reduced to a value within a range of from about $1\times10^{10}$ ohm-cm to about $1\times10^{5}$ ohm-cm, and more preferably from about $1\times10^{9}$ ohm-cm to about $1\times10^{7}$ ohm-cm. The foregoing resistivity ranges are preferred, since a resistivity value within such ranges can inhibit or at least reduce the amount of I-CPU without effecting the high magnetic properties of the hard magnetic material. Thus, the carrier particles of the present invention can, in such embodiments, provide high levels of development efficiency (and thereby a faster electrographic imaging process), without significant, or at least undesirable, levels of I-CPU, as is exemplified by the examples which follow hereinafter, as well as those illustrated in copending U.S. patent application Ser. No. 60/204,941 filed on even date herewith and previously incorporated herein by reference.

Using a qualitative method for determining the I-CPU performance of a developer using a magnetic carrier, as described in the examples which follow hereinafter, one can describe the amount of carrier particles which are separated from the brushed nap of the development zone and deposited onto the electrostatic image being developed. In many instances, the conductive carriers of the present invention can exhibit no apparent deposition of carrier into the image, or only weak to light levels of deposition (a level of 2 or below based on the qualitative I-CPU determination described in the examples), and preferably, exhibit no visual evidence of deposition on the photoconductor (a level of 0 in the qualitative test) when the carriers of the invention are used in a electrographic process.

In a preferred embodiment, the carrier has a core of a hard magnetic ferrite material with a single-phase, hexagonal crystal structure. The core preferably has an outer surface with a metal oxide composition disposed thereon represented by the formula $MO_{n/2}$, wherein M is at least one multi-valent metal represented by $M^{n+}$ with n being an integer of at least 4. Preferably, n is 4, 5 or 6, and more preferably, n is 4 or 5. Most preferably, n is 4.

In preferred embodiments, the metals for the conductive metal oxide composition are any metallic element that can form a multi-valent metal ion in the hard magnetic material's crystal structure such that n in the foregoing formula is 4 or more. Such metals include, for example, antimony, arsenic, germanium, hafnium, molybdenum, niobium, silicon, tantalum, tellurium, tin, titanium, tungsten, vanadium, zirconium, and mixtures thereof. Preferably, the metal is selected from silicon, zirconium, tin, titanium, or mixtures thereof, which metals are more readily available and therefore have a relatively low raw material cost. Examples of metal oxides which may be employed include $GeO_2$, $ZrO_2$, $TiO_2$, $SnO_2$, and mixtures thereof.

The amount of metal oxide composition employed should be that which yields a conductive carrier, i.e., a drop in resistivity of at least about $1\times10^{11}$ ohm-cm relative to a carrier of the hard magnetic material without the metal oxide thereon as described above. Desirably, the metal oxide composition may be applied in an amount of from about 0.01 to about 3 weight percent based on total weight of the carrier. Preferably, the metal oxide composition is present in an amount of from about 0.02 to about 2 weight percent, and more preferably from about 0.025 to about 1 weight percent based on total carrier weight.

Optionally, the conductive metal oxide composition on the core may further comprise at least one second metal oxide which does not substantially contribute toward enhancement of carrier conductivity, but may add charge tunability and/or coating (deposit) integrity, such as a glassy boron oxide ($B_2O_3$) co-deposit, but preferably the second metal oxide is an alkali metal oxide, such as lithium oxide, potassium oxide, sodium oxide, or mixtures thereof, which can enhance conductivity, even when coated onto the carrier without a co-deposit of the multi-valent metal oxide.

Where a second metal oxide is employed in the conductive metal oxide composition, it is generally present in an amount of from 0.01 to about 1 weight percent, based on total carrier weight.

The preparation of magnetic ferrites generally and hard, hexagonal crystal structure ferrites (Ba, Sr or Pb) in particular, are well documented in the literature. Any suitable method of making the ferrite particles may be employed, such as the methods disclosed in U.S. Pat. Nos. 3,716,630, 4,623,603 and 4,042,518, the teachings of which are incorporated herein by reference in their entirety; European Patent Application No. 0 086 445; "Spray Drying" by K. Masters published by Leonard Hill Books London, pages 502–509 and "Ferromagnetic Materials", Volume 3 edited by E. P. Wohlfarth and published by North-Holland Publishing Company, Amsterdam, N.Y., Oxford, pages 315 et seq, the teachings of which are also incorporated herein by reference.

In general, the conductive carriers of the present invention can be prepared by a solution coating and firing technique as described hereinafter. Initially, a hard magnetic material in particulate form is provided, which can be prepared by any method known to the art, such as those methods described in the foregoing art references. As such, the particulate material functions as the core for the carriers of the present invention. The particulate core material is then admixed with a solution comprising a solvent and at least one metal oxide precursor compound. The admixture is then heated, preferably with agitation as necessary, to remove solvent therefrom and provide a coating of the at least one metal oxide precursor compound on the surface of the core particles. After placing a coating of the metal oxide precursor compounds on the core particles, the so-coated particles are fired in an oxidizing atmosphere at a temperature sufficient to form the desired metal oxide composition on the outer surface of the core particles.

When admixing the particulate core material with the metal oxide precursor solution, the amount of solution used should be sufficient to at least wet the surfaces of the particulate ferrite material. A significant excess of the solution is undesirable, since the solvent in the solution must be removed in subsequent processing steps.

The solution of at least one metal oxide precursor compound may be prepared by dissolving at least one metal oxide precursor compound into a suitable solvent. Desirably, the solvent should be easily vaporized since the preparation method disclosed herein involves removal of the solvent prior to formation of the conductive metal oxide composition. Suitable solvents include water, and other common organic solvents such as methanol, ethanol, isopropanol, toluene, hexane, and the like. Preferred solvents are water, methanol, and isopropanol. By the term "solution", it is also contemplated that a colloidal dispersion of the metal oxide precursor compound can be used.

The compounds employed for the metal oxide precursor solution are those which, upon firing in an oxidizing atmosphere at the temperatures described below, yield the desired metal oxides. Desirably, the compounds are those which may readily be dissolved into the above-described solvents and yield the metals as described hereinabove. Generally, metal salts of organic acids, carbonates, halides, and nitrates are dissolvable and/or dispersible in common solvents and yield good results.

The amount of the at least one metal oxide precursor compound employed in the above-described coating solution is selected such that, upon firing, a metal oxide composition is obtained which is within the weight percent ranges previously given as to the proportion of the metal oxide composition in the final conductive carrier particles. Generally, an amount of from about 0.01 to about 5 weight percent of the metal oxide precursor compound in the solution is sufficient.

After admixing the ferrite core particles with the coating solution, heat is applied to the admixture to remove excess solvent therefrom and obtain dry, or nearly dry, particles coated with the metal oxide precursor compounds. This step may be accomplished by heating the admixture under moderate heat of about 100 to about 150° C. for a time sufficient to remove the solvent without significant conversion of the metal oxide precursor compounds to their oxide forms. The pressure used during the drying step can also be reduced in order to use lower temperatures for the drying step.

After removal of the solvent, the so-coated core particles are fired, i.e., calcined, within an oxidizing atmosphere at a temperature sufficient to substantially convert the metal oxide precursor compounds to their oxide form. Generally, this step can be accomplished in a high temperature furnace. The temperature at which the precursor compounds thermally decompose and convert to their oxide form will depend on the precursor selected, but generally, a firing temperature of at least about 250° C. is desired. The firing temperature can be as high as about 1300° C. As mentioned in the examples that follow and as illustrated in FIG. 1, depending on the hard magnetic material selected, as the firing temperature is increased, there is typically a firing temperature at which a significant drop in the resulting carrier resistivity occurs. While not wishing to be bound by theory, it is believed that such significant drop in resistivity is the result of significant reaction of the metal oxide with the core's magnetic material, such that the metal oxide is incorporated into the magnetic material thereby forming a conductive region within the transition zone previously described herein. Preferably, the firing temperature is selected such that the resistivity for the final carrier is within the preferred ranges specified above due to I-CPU concerns.

After firing, the resulting conductive carrier may be deagglomerated to yield the carrier in its final form, that is, beads with a volume average particle diameter of less than 100 $\mu$m, preferably from about 3 to 65 $\mu$m, and more preferably, from about 5 to about 20 $\mu$m. The resulting carrier particles are then magnetized by subjecting them to an applied magnetic field of sufficient strength to yield magnetic hysteresis behavior.

The present invention comprises two types of carrier particles. The first of these carriers comprises a binder-free, magnetic particulate hard magnetic ferrite material, having disposed on the surface thereof a conductive metal oxide coating, and exhibiting the requisite coercivity and induced magnetic moment as previously described. This type of carrier is preferred.

The second is heterogeneous and comprises a composite of a binder (also referred to as a matrix) and a magnetic material exhibiting the requisite coercivity and induced magnetic moment. The hard magnetic ferrite material as previously described herein is dispersed as discrete smaller particles throughout the binder. However, binders employed as known to those in the art can be highly resistive in nature, such as in the case of a polymeric binder, such as vinyl resins like polystyrene, polyester resins, nylon resins, and polyolefin resins as described in U.S. Pat. No. 5,256,513. As such, any reduction in conductivity of the magnetic ferrite material may be offset by the resistivity of the binder selected. It should be appreciated that the resistivity of these composite carriers must be comparable to the binder-less carrier in order for advantages concerning development efficiency as previously described to be realized. It may be desirable to add conductive carbon black to the binder to facilitate electrical conductance between the ferrite particles.

The individual bits of the magnetic ferrite material should preferably be of a relatively uniform size and sufficiently smaller in diameter than the composite carrier particle to be produced. Typically, the average diameter of the magnetic material should be no more than about 20 percent of the average diameter of the carrier particle. Advantageously, a much lower ratio of average diameter of magnetic component to carrier can be used. Excellent results are obtained with magnetic powders of the order of 5 $\mu$m down to 0.05 $\mu$m average diameter. Even finer powders can be used when the degree of subdivision does not produce unwanted modifications in the magnetic properties and the amount and character of the selected binder produce satisfactory strength, together with other desirable mechanical and electrical properties in the resulting carrier particle.

The concentration of the magnetic material in the composite can vary widely. Proportions of finely divided magnetic material, from about 20 percent by weight to about 90 percent by weight, of composite carrier can be used as long as the resistivity of the particles is that representative of the ferrite particles as described above.

The induced moment of composite carriers in a 1000 Oersteds applied field is dependent on the concentration of magnetic material in the particle. It will be appreciated, therefore, that the induced moment of the magnetic material should be sufficiently greater than about 20 EMU/gm to compensate for the effect upon such induced moment from dilution of the magnetic material in the binder. For example, one might find that, for a concentration of about 50 weight percent magnetic material in the composite particles, the 1000 Oersteds induced magnetic moment of the magnetic material should be at least about 40 EMU/gm to achieve the minimum level of 20 EMU/gm for the composite particles.

The binder material used with the finely divided magnetic material is selected to provide the required mechanical and electrical properties. It should (1) adhere well to the magnetic material, (2) facilitate formation of strong, smooth-surfaced particles and (3) preferably possess sufficient difference in triboelectric properties from the toner particles with which it will be used to insure the proper polarity and magnitude of electrostatic charge between the toner and carrier when the two are mixed.

The matrix can be organic, or inorganic, such as a matrix composed of glass, metal, silicone resin or the like. Preferably, an organic material is used such as a natural or synthetic polymeric resin or a mixture of such resins having appropriate mechanical properties. Appropriate monomers (which can be used to prepare resins for this use) include, for example, vinyl monomers such as alkyl acrylates and methacrylates, styrene and substituted styrenes, and basic monomers such as vinyl pyridines. Copolymers prepared with these and other vinyl monomers such as acidic monomers, e.g., acrylic or methacrylic acid, can be used. Such copolymers can advantageously contain small amounts of polyfunctional monomers such as divinylbenzene, glycol dimethacrylate, triallyl citrate and the like. Condensation polymers such as polyesters, polyamides or polycarbonates can also be employed.

Preparation of composite carrier particles according to this invention may involve the application of heat to soften thermoplastic material or to harden thermosetting material; evaporative drying to remove liquid vehicle; the use of pressure, or of heat and pressure, in molding, casting, extruding, or the like and in cutting or shearing to shape the carrier particles; grinding, e.g., in a ball mill to reduce carrier material to appropriate particle size; and sifting operations to classify the particles.

According to one preparation technique, the powdered magnetic material is dispersed in a solution of the binder resin. The solvent may then be evaporated and the resulting solid mass subdivided by grinding and screening to produce carrier particles of appropriate size. According to another technique, emulsion or suspension polymerization is used to produce uniform carrier particles of excellent smoothness and useful life.

The coercivity of a magnetic material refers to the minimum external magnetic force necessary to reduce the induced magnetic moment from the remanance value to zero while it is held stationary in the external field, and after the material has been magnetically saturated, i.e., the material has been permanently magnetized. A variety of apparatus and methods for the measurement of coercivity of the present carrier particles can be employed. For the present invention, a Lakeshore Model 7300 Vibrating Sample Magnetometer, available from Lakeshore Cryotronics of Westerville, Ohio, is used to measure the coercivity of powder particle samples. The magnetic ferrite powder is mixed with a nonmagnetic polymer powder (90 percent magnetic powder; 10 percent polymer by weight). The mixture is placed in a capillary tube, heated above the melting point of the polymer, and then allowed to cool to room temperature. The filled capillary tube is then placed in the sample holder of the magnetometer and a magnetic hysteresis loop of external field (in Oersteds) versus induced magnetism (in EMU/gm) is plotted. During this measurement, the sample is exposed to an external field of 0 to ±8000 Oersteds.

The carrier particles may be coated to properly charge the toner particles of the developer. This can be done by forming a dry mixture of the ferrite material with a small amount of powdered resin, e.g., from about 0.05 to about 3.0 weight percent resin based on total weight of the hard magnetic material and resin, and then heating the mixture to fuse the resin. Such a low concentration of resin will form a thin or discontinuous layer of resin on the ferrite particles.

Since the presence of the metal oxide composition is intended to improve conductivity of carrier particles, the layer of resin on the carrier particles should be thin enough that the mass of particles remains suitably conductive. Preferably the resin layer is discontinuous for this reason; spots of bare carrier on each particle provide conductive contact.

Various resin materials can be employed as a coating on the hard magnetic carrier particles. Examples include those described in U.S. Pat. Nos. 3,795,617; 3,795,618, and 4,076,857, the teachings of which are incorporated herein by reference in their entirety. The choice of resin will depend upon its triboelectric relationship with the intended toner. For use with toners which are desired to be positively charged, preferred resins for the carrier coating include fluorocarbon polymers such as poly(tetrafluoroethylene), poly(vinylidene fluoride) and poly(vinylidene fluoride-co-tetrafluoroethylene) For use with toners which are desired to be negatively charged, preferred resins for the carrier include silicone resins, as well as mixtures of resins, such as a mixture of poly(vinylidene fluoride) and polymethylmethacrylate. Various polymers suitable for such coatings are also described in U.S. Pat. No. 5,512,403, the teachings of which are incorporated herein by reference in their entirety.

The developer is formed by mixing the carrier particles with toner particles in a suitable concentration. Within developers of the invention, high concentrations of toner can be employed. Accordingly, the present developer preferably contains from about 70 to 99 weight percent carrier and about 30 to 1 weight percent toner based on the total weight of the developer; most preferably, such concentration is from about 75 to 99 weight percent carrier and from about 25 to 1 weight percent toner.

The toner component of the invention can be a powdered resin which is optionally colored. It normally is prepared by compounding a resin with a colorant, i.e., a dye or pigment, either in the form of a pigment flush (a special mixture of pigment press cake and resin well-known to the art) or pigment-resin masterbatch, as well as any other desired addenda known to art. If a developed image of low opacity is desired, no colorant need be added. Normally, however, a colorant is included and it can, in principle, be any of the materials mentioned in Colour Index, Vols. I and II, 2nd Edition. Carbon black is especially useful. The amount of colorant can vary over a wide range, e.g., from about 3 to about 20 weight percent of the toner component. Combinations of colorants may be used as well.

The mixture of resin and colorant is heated and milled to disperse the colorant and other addenda in the resin. The mass is cooled, crushed into lumps and finely ground. The resulting toner particles can range in diameter from about 0.5 to about 25 $\mu$m with a volume average particle diameter of from about 1 to about 16 $\mu$m, and preferably from about 10 $\mu$m to about 4 $\mu$m. Preferably, the average particle size ratio of carrier to toner particles lies within the range from about 15:1 to about 1:1. However, carrier-to-toner average particle size ratios of as high as 50:1 are useful.

The toner resin can be selected from a wide variety of materials, including both natural and synthetic resins and modified natural resins, as disclosed, for example, in U.S. Pat. No. No. 4,076,857. Especially useful are the crosslinked polymers disclosed in U.S. Pat. Nos. 3,938,992 and 3,941,898. The crosslinked or noncrosslinked copolymers of styrene or lower alkyl styrenes with acrylic monomers such as alkyl acrylates or methacrylates are particularly useful. Also useful are condensation polymers such as polyesters. Numerous polymers suitable for use as toner resins are disclosed in U.S. Pat. No. 4,833,060. The teachings of U.S. Pat. Nos. 3,938,992, 3,941,898, 4,076,857; and 4,833,060 are incorporated by reference herein in their entirety.

The shape of the toner can be irregular, as in the case of ground toners, or spherical. Spherical particles are obtained by spray-drying a solution of the toner resin in a solvent. Alternatively, spherical particles can be prepared by the polymer bead swelling technique disclosed in European Pat. No. 3905 published Sep. 5, 1979, to J. Ugelstad, as well as by suspension polymerization, such as the method disclosed in U.S. Pat. No. 4,833,060, previously incorporated by reference.

The toner can also contain minor amounts of additional components as known to the art, such as charge control agents and antiblocking agents. Especially useful charge control agents are disclosed in U.S. Pat. Nos. 3,893,935 and 4,206,064, and British Pat. No. 1,501,065, the teachings of which are incorporated herein by reference in their entirety. Quaternary ammonium salt charge agents as disclosed in Research Disclosure, No. 21030, Volume 210, October, 1981 (published by Industrial Opportunities Ltd., Homewell, Havant, Hampshire, PO9 1EF, United Kingdom) are also useful.

In an embodiment of the method of the present invention, an electrostatic image is brought into contact with a magnetic brush development station comprising a rotating-magnetic core, an outer non-magnetic shell, and either the one-component or two-component, dry developers as described hereinabove. The electrostatic image so developed can be formed by a number of methods such as by imagewise photodecay of a photoreceptor, or imagewise application of a charge pattern on the surface of a dielectric recording element. When photoreceptors are employed, such as in high-speed electrophotographic copy devices, the use of halftone screening to modify an electrostatic image can be employed, the combination of screening with development in accordance with the method for the present invention producing high-quality images exhibiting high Dmax and excellent tonal range. Representative screening methods including those employing photoreceptors with integral half-tone screens are disclosed in U.S. Pat. No. 4,385,823.

Developers comprising magnetic carrier particles in accordance with the present invention when employed in an apparatus such as that described in U.S. Pat. No. 4,473,029 can exhibit a dramatic increase in development efficiency when compared with traditional magnetic ferrite materials as employed in U.S. Pat. No. 4,473,029 when operated at the same voltage differential of the magnetic brush and photoconductive film. For example, when the performance of traditional strontium ferrite carrier particles, similar in all respects except for the presence of the above-described multi-valent metal ion, are compared with the carrier particles of the present invention, the development efficiency can be improved at least from about 50 percent, and preferably up to 100 percent and even 200 percent, all other conditions of development remaining the same. Thus, by employing the carrier particles in accordance with this invention, the operating conditions such as the voltage differential, the exposure energy employed in forming the latent electrostatic image, and the speed of development, may all be varied in order to achieve optimum conditions and results.

The invention is further illustrated by the following examples:

SPECIFIC EMBODIMENTS OF THE INVENTION

In the following examples, all parts and percentages are by weight and temperatures are in degrees Celsius (°C.), unless otherwise indicated.

EXAMPLES 1–7

Strontium Ferrite Carriers Coated With 1 pph $GeO_2$ and Fired at Various Furnace Temperatures For Examples 1–7, a commercially-prepared $SrFe_{12}O_{19}$ hard ferrite carrier is coated with 1 part of $GeO_2$ per 100 parts of carrier (0.99 wt % based on total weight of the final carrier particles) according to the present invention and the temperature at which the carrier is fired is varied to show the effects of calcining temperature on the resulting carrier's resistivity and performance.

The coated carrier particles are prepared using $SrFe_{12}O_{19}$ hard magnetic ferrite particles available from POWDERTECH of Valparaiso, Ind. A slurry of the ferrite particles is made by placing a 400 gram (g) amount of the $SrFe_{12}O_{19}$ ferrite particles into a glass dish, along with a combined solution of 67 milliliters (ml) of an ammonium germanate solution and 122 ml of methanol. The ammonium germanate solution is made by adding, with agitation, a 120 g amount of $GeO_2$ powder (chemical grade—99.999% purity) obtained from Eagle Picher Company of Quapaw, Okla. into 2,000 ml of distilled water in a glass flask, followed by dropwise addition of 33 ml of a concentrated $NH_4OH$ solution into the flask to dissolve the $GeO_2$ powder. The resulting ammonium germanate solution has a final pH of 8.5 with a germanium oxide content of 60 grams per liter (g/l).

The slurry as described above is mixed under an infrared heat lamp to dryness, followed by overnight heating in an oven set at 100° C., so as to remove water. At this point, the chemical species present in the ammonium germanate solution have not yet thermally decomposed to an oxide form. The so-coated carrier particles are then fired to thermally decompose the ammonium germanate surface coating by placing an aliquot of at least 20 g of the carrier particles into an alumina tray and charging them into a high temperature box furnace. The temperature of the furnace is ramped at a rate of 7° C./min to a temperature of from 250° C. (Example 1) to 1150° C. (Example 7) (the firing temperature for each example is listed in Table I hereinafter), at which point the temperature is maintained for 2 hours. After firing for two hours, the furnace is allowed to cool without control (i.e., "free-fall") to room temperature. The fired carrier charges are deagglomerated with a mortar and pestle and screened through a 200 mesh screen to obtain strontium ferrite carrier particles having $GeO_2$ deposited on the surfaces of the ferrite particles. As mentioned above, and without being bound by theory, it is believed that as the firing temperature increases, the oxide coating reacts to a greater extent with the core material, thereby resulting in higher concentrations of $Ge^{4+}$ ion within the above-described transition zone near the surface of the ferrite core material.

The resistivities measured for each resulting carrier are shown in Table I below. Static resistivity is measured using a cylindrically-shaped electrical cell. The cell employed has a cylindrical chamber therein which is concentric with the centerline of the cell. The cell is in two parts, an upper section with an electrode piston located concentrically therein and aligned along the centerline of the cylinder, and a bottom section with an electrode base. The upper section connects to the bottom section, thereby forming the cell's overall cylindrical shape. The circular bottom surface of the piston within the upper section and the circular base of the bottom section define the ends of the cylindrical chamber within the cell. The piston can be actuated and extended downwardly along the centerline of the cell by a small lever that extends radially outward from the cylinder. The base of the bottom section of the cell has small, centered electrode therein. The piston is itself an electrode, which thereby provides an opposing electrode. To use the cell, approximately 2.00 g of carrier to be tested is placed on the circular metal base in contact with the electrode. The top portion of the cell is placed on the bottom electrode base and aligned. The release lever is lowered and the piston electrode from the upper section is lowered onto the powder. The depth of the powder is adjusted by physical rotation of the top portion of the cell to give a spacing of 0.04 inches. The average resistivity (in ohm-cm) is determined by measurement of the electrical current flow through the cell using a Keithley Model 616 current meter (obtained from Keithley Corporation of Cleveland, Ohio) for three applied voltages in a range of 10–250 V. Resistivity is determined using Ohm's law. The resistivities for each carrier are also shown in FIG. 1, which is a graph of resistivity (in ohm-cm) versus firing temperature (in °C.). As can be seen in FIG. 1, the resistivity of the carrier sharply drops at above 600° C.

For each example, the resulting coated carrier is used to prepare a two-component developer using a yellow polyester toner prepared substantially as described in U. S. Pat. No. 4,833,060, the teachings of which have been previously incorporated by reference herein. The developer is produced by mixing together each carrier with the above-described toner using a toner concentration (TC) of about 6 wt % (the actual measured value for TC is shown in Table I). For each example, the charge-to-mass ratio (q/m) is measured and the value obtained is also shown in Table I.

Toner charge to mass (q/m) is measured in microcoulombs per gram ($\mu$C/g) within a "MECCA" device described hereinafter, after being subjected to the "exercise periods", also as described hereinafter.

The first exercise period consists of vigorously shaking the developer to cause triboelectric charging by placing a 4–7 g portion of the developer into a 4 dram glass screw cap vial, capping the vial and shaking the vial on a "wrist-action" robot shaker operated at about 2 Hertz (Hz) and an overall amplitude of about 11 centimeters (cm) for 2 minutes. The charge, if obtained at this point, is commonly referred to as the "fresh" charge in the tables that follow hereinafter.

The developer is also subjected to an additional, exercise period of 2 minutes and/or 10 minutes on top of a rotating-core magnetic brush. The vial as taken from the robot shaker is constrained to the brush while the magnetic core is rotated at 2000 rpm to approximate actual use of the developer in an electrographic process. Thus, the developer is exercised as if it were directly on a magnetic brush, but without any loss of developer, because it is contained within the vial. Toner charge level after this exercise is designated as "2 min BB" or "10 min BB" in the tables hereinafter.

The toner q/m ratio is measured in a MECCA device comprised of two spaced-apart, parallel, electrode plates which can apply both an electrical and magnetic field to the developer samples, thereby causing a separation of the two components of the mixture, i.e., carrier and toner particles, under the combined influence of a magnetic and electric field. A 0.100 g sample of a developer mixture is placed on the bottom metal plate. The sample is then subjected for thirty (30) seconds to a 60 Hz magnetic field and potential of 2000 V across the plates, which causes developer agitation. The toner particles are released from the carrier particles under the combined influence of the magnetic and electric fields and are attracted to and thereby deposit on the upper electrode plate, while the magnetic carrier particles are held on the lower plate. An electrometer measures the accumulated charge of the toner on the upper plate. The toner q/m ratio in terms of microcoulombs per gram ($\mu$C/g) is calculated by dividing the accumulated charge by the mass of the deposited toner taken from the upper plate.

The performance of the toners prepared using the carriers produced by Examples 1–7 are determined using an electrographic device as described in U.S. Pat. No. 4,473,029, the teachings of which have been previously incorporated herein in their entirety. The device has two electrostatic probes, one before a magnetic brush development station and one after the station to measure the voltage on an organic photoconductive film before and after development of an electrostatic image on the photoconductive film. The voltage of the photoconductor is set at −550 volts and the magnetic brush is maintained at −490 volts, for a total offset of +60 volts. The shell and photoconductor are set at a spacing of 0.020 inches, the core is rotated clockwise at 1000 rpm, and the shell is rotated at 15 rpm counter-clockwise. Through the charging station, the photoconductor is set to travel at a speed of 2 inches per second, while in the development section the photoconductor is set to travel at a speed of 5 inches per second. The nap density is 0.24 g/in$^2$. The carrier particles and toner used are those as prepared in Examples 1–7 hereinabove, respectively. The voltage on the photoconductor after charging and exposure to a step-wedge density target is measured by the first probe after development, the voltage on the photoconductor film in the developed areas is measured by the second probe. The development efficiency is calculated for a high density area by comparison of the pre- and post-exposure voltages on the photoconductor. After development, the voltage on the photoconductive film in developed areas is measured, thereby allowing for calculation of a development efficiency for each example as shown in Table I.

Development efficiency is defined as a percentage of the potential difference between the photoreceptor in the developed image areas before and after toner development divided by the potential difference between the photoreceptor prior to development. For example, in a discharged area development configuration with a negative toner, if the photoconductor film voltage is −100 V and the magnetic brush is −500 V, the potential difference is 400 V prior to development. If during development, the film voltage is reduced by −200 V to −300 V in the image areas by the deposition of negative toner particles, the development efficiency would be 200 V/400 V, or 50%. The relative development efficiency (Rel DE) is calculated as a ratio of the measured development efficiency for a given example over the development efficiency of the developer employed in Comparative Example A (discussed hereinbelow) which uses a conventional strontium ferrite carrier obtained from POWDERTECH which has not been treated so as to have $GeO_2$ deposited on the surface of the strontium ferrite carrier as in the examples described above. The reference to I-CPU is a qualitative determination of the extent to which carrier is being picked-up, i.e., deposited onto the photoconductor, and is determined by visually inspecting the high density region from the step-wedge image and comparing the density of deposited carrier particles. A numerical scale is assigned to various levels of I-CPU deposition, with 0—being none, 1—very weak, 2—weak, 3—weak to moderate, 4—moderate, 5—moderate to high, 6—high, and 7—very high.

TABLE I

Examples 1–7 - Resistivity & Performance Data

| Example | Temp | Resistivity | Fresh | | 10 min BB | | | |
|---|---|---|---|---|---|---|---|---|
| No. | (° C.) | (ohm-cm) | g/m | TC | g/m | TC | Rel DE* | I-CPU |
| 1 | 250 | $2.4 \times 10^{11}$ | −38.8 | 6.4 | −43.5 | 6.0 | 1.45 | None (0) |
| 2 | 400 | $5.9 \times 10^{11}$ | −43.6 | 6.1 | −47.3 | 6.3 | 0.99 | None (0) |
| 3 | 600 | $2.0 \times 10^{11}$ | −39.4 | 6.3 | −41.8 | 6.2 | 1.54 | None (0) |
| 4 | 750 | $2.3 \times 10^{6}$ | −32.5 | 6.5 | −35.7 | 6.0 | 2.69 | High (6) |
| 5 | 900 | $1.7 \times 10^{5}$ | −75.3 | 5.9 | −85.1 | 6.3 | 2.90 | High (6) |
| 6 | 1050 | $1.5 \times 10^{5}$ | −80.9 | 6.8 | −89.5 | 6.3 | 3.02 | High (6) |
| 7 | 1150 | $2.7 \times 10^{5}$ | −52.5 | 6.3 | −59.8 | 6.2 | 2.24 | High (6) |
| Comp A | — | $1.0 \times 10^{10}$ | −74.0 | 7.0 | −74.5 | 6.4 | 1.00 | None (0) |
| Comp B | — | $5.0 \times 10^{6}$ | −72.0 | 6.9 | −75.2 | 6.3 | 3.02 | High (6) |

*Relative to Comparative Example A.

As can be seen from Table I, the relationship between static resistivity, development efficiency and I-CPU is apparent; higher conductivity increases the development rate and I-CPU. At the highest core conductivities, it is apparent that high conductivity also induces carrier pickup in the image area. The $GeO_2$ composition deposited on the strontium ferrite core, however, permits an opportunity, by selection of firing conditions, to adjust the conductivity of the resulting carrier and its performance when used as a carrier in an electrographic process. As seen in Table I and FIG. 1, the resistivity drops approximately four orders of magnitude between Examples 3 and 4 (with firing temperatures of 600° C. and 750° C. respectively), and FIG. 1 illustrates generally the trend in static resistivity.

Comparative Example A

In Comparative Example A, the static resistivity, triboelectric properties, and development performance of a commercially-prepared $SrFe_{12}O_{19}$ hard ferrite carrier are measured according to the analytical procedures described in Examples 1–7 and are compared to the results obtained in Examples 1–7. The carrier is a $SrFe_{12}O_{19}$ hard ferrite obtained from POWDERTECH of Valparaiso, Ind. This carrier is used to make a developer with the same toner as described in Examples 1–7. The resistivity, triboelectric properties, and development performance obtained using this carrier are shown in Table I above.

Comparative Example B

In Comparative Example B, the static resistivity, triboelectric properties, and development performance of a commercially-prepared $SrFe_{12}O_{19}$ hard ferrite carrier which has been bulk substituted with lanthanum are measured according to the analytical procedures described in Examples 1–7 and are compared to the results obtained in Examples 1–7. The carrier is provided by POWDERTECH of Valparaiso, Ind. The carrier contains about 2.8 wt % lanthanum. This carrier is used to make a developer with the same toner as described in Examples 1–7. The resistivity, triboelectric properties, and development performance obtained using this carrier are shown in Table I above.

EXAMPLES 8–11

Strontium Ferrite Carriers With Varying Levels of $GeO_2$

For Examples 8–11, the procedure of Examples 1–7 is substantially repeated, except as provided hereinafter. The same $SrFe_{12}O_{19}$ hard magnetic ferrite particles are used, except that they are coated with varying amounts of $GeO_2$. The firing temperature employed is 750° C.

For Example 8, the slurry of ferrite particles and ammonium germanate solution is prepared by mixing 50 g of the ferrite particles with 0.834 ml of the ammonium germanate solution previously prepared and 22 ml of methanol. The resulting carrier has a $GeO_2$ coating of 0.10 pph, i.e., about 0.099 wt % based on total weight of the carrier.

For Example 9, the slurry of ferrite particles and ammonium germanate solution is prepared by mixing 50 g of the ferrite particles with 2.1 ml of the ammonium germanate solution previously prepared and 21 ml of methanol. The resulting carrier has a $GeO_2$ coating of 0.25 pph, i.e., about 0.25 wt % based on total weight.

For Example 10, the slurry of ferrite particles and ammonium germanate solution is prepared by mixing 50 g of the ferrite particles with 4.2 ml of the ammonium germanate solution previously prepared and 19 ml of methanol. The resulting carrier has a $GeO_2$ coating of 0.50 pph, i.e., about 0.5 wt %.

For Example 11, the slurry of ferrite particles and ammonium germanate solution is prepared by mixing 50 g of the ferrite particles with 8.4 ml of the ammonium germanate solution previously prepared and 15 ml of methanol. The resulting carrier has a $GeO_2$ coating of 1 pph, i.e., about 0.99 wt %.

All other procedures used are substantially the same as those used in Examples 1–7. The resistivities for each carrier are measured by the same analytical procedure described in Examples 1–7 and are shown in Table II below.

TABLE II

Examples 8–11 - Resistivity Data

| Example No. | $GeO_2$ Loading (pph) | Resistivity (ohm-cm) |
|---|---|---|
| 8 | 0.10 | $4.6 \times 10^7$ |
| 9 | 0.25 | $3.4 \times 10^6$ |
| 10 | 0.50 | $2.6 \times 10^6$ |
| 11 | 1.0 | $2.3 \times 10^6$ |

As can be seen from Table II, static resistivity of the carrier can be varied by adjusting the level of $GeO_2$ deposited on the carrier and firing at 750° C.

EXAMPLES 12–19

Strontium Ferrite Carriers Coated With Mixed $GeO_2/B_2O_3$ Coating

For Examples 12–19, a commercially prepared $SrFe_{12}O_{19}$ hard ferrite carrier is coated with a mixed $GeO_2/B_2O_3$ composition according to the present invention. The carriers are prepared using generally the procedures as described in Examples 1–7 above, except as provided hereinbelow.

For Example 12, a slurry of the ferrite particles is made by placing a 50 gram (g) amount of the $SrFe_{12}O_{19}$ ferrite particles into a glass dish, along with 30 ml of an ammonium germanate-boric acid solution. The ammonium germanate-boric acid solution is made by adding 10 ml of the ammonium germanate solution made as in Examples 1–7 with 10 ml of distilled water and 10 ml of a methanolic boric acid solution. The methanolic boric acid solution is made by adding 0.22 g of $H_3BO_3$ (reagent grade obtained from Acros Company of New Jersey, USA) to 10 ml of methanol. The procedure of Examples 1–7 is substantially repeated at a furnace temperature of 600° C. to yield a carrier coated with a mixed $GeO_2/B_2O_3$ oxide composition having the stoichiometry of 1.2 pph $GeO_2$ (1.17 wt % based on total weight of the carrier) and 0.5 pph $B_2O_3$ (0.487 wt %).

For Example 13, a slurry of the ferrite particles is made by placing a 50 gram (g) amount of the $SrFe_{12}O_{19}$ ferrite particles into a glass dish, along with 30 ml of an ammonium germanate-boric acid solution. The ammonium germanate-boric acid solution is made by adding 10 ml of the ammonium germanate solution made as in Examples 1–7 with 10 ml of distilled water and 10 ml of a methanolic boric acid solution. The methanolic boric acid solution is made by adding 0.44 g of the $H_3BO_3$ to the 10 ml of methanol. The procedure of Examples 1–7 is substantially repeated at a furnace temperature of 600° C. to yield a carrier coated with a mixed $GeO_2/B_2O_3$ oxide composition having the stoichiometry of 1.2 pph $GeO_2$ and 1.0 pph $B_2O_3$.

For Example 14, a slurry of the ferrite particles is made by placing a 50 gram (g) amount of the $SrFe_{12}O_{19}$ ferrite particles into a glass dish, along with 25 ml of an ammonium germanate-boric acid solution. The ammonium germanate-boric acid solution is made by adding 5 ml of the ammonium germanate solution made as in Examples 1–7 with 10 ml of distilled water and 10 ml of a methanolic boric acid solution. The methanolic boric acid solution is made by adding 0.44 g of the $H_3BO_3$ to the 10 ml of methanol. The procedure of Examples 1–7 is substantially repeated at a furnace temperature of 600° C. to yield a carrier coated with a mixed $GeO_2/B_2O_3$ oxide composition having the stoichiometry of 0.6 pph $GeO_2$ and 1.0 pph $B_2O_3$.

For Example 15, a slurry of the ferrite particles is made by placing a 50 gram (g) amount of the $SrFe_{12}O_{19}$ ferrite particles into a glass dish, along with 35 ml of an ammonium germanate-boric acid solution. The ammonium germanate-boric acid solution is made by adding 5 ml of the ammonium germanate solution made as in Examples 1–7 with 10 ml of distilled water and 20 ml of a methanolic boric acid solution. The methanolic boric acid solution is made by adding 0.88 g of the $H_3BO_3$ to the 20 ml of methanol. The procedure of Examples 1–7 is substantially repeated at a furnace temperature of 600° C. to yield a carrier coated with a mixed $GeO2/B_2O_3$ oxide composition having the stoichiometry of 0.6 pph $GeO_2$ and 2.0 pph $B_2O_3$.

For Examples 16–19, the procedures for Example 12–15 respectively are substantially repeated, except the furnace temperature is 900° C. in each instance.

The resistivities measured for each resulting carrier are shown in Tables III and IV below.

For Examples 12–15, the resulting carriers are used to prepare a two-component developer using a ground magenta polyester toner. The developer is produced by mixing together each carrier with the above-described toner using a toner concentration (TC) of about 6 wt % (the actual measured value for TC is shown in Table II). For each example, the charge-to-mass ratio (q/m) in microcoulombs per gram ($\mu$C/g) and TC are measured as in Examples 1–7, and the values obtained are also shown in Table III.

For Examples 16–19, the resulting carrier is used to prepare a two-component developer using the yellow polyester toner substantially as described in Examples 1–7. For each example, the charge-to-mass ratio (q/m) in microcoulombs per gram ($\mu$C/g) and toner concentration (TC) in weight percent (wt %) are measured as in Examples 1–7, and the values obtained are also shown in Table IV.

TABLE III

Examples 12–15 Data For Various $GeO_2/B_2O_3$ Coatings Fired @ 600° C.

| Example No. | $GeO_2/B_2O_3$ (pph) | Resistivity (ohm-cm) | Fresh g/m | Fresh TC | 2 min BB g/m | 2 min BB TC | 10 min BB g/m | 10 min BB TC |
|---|---|---|---|---|---|---|---|---|
| 12 | 1.2/0.5 | $2.2 \times 10^{11}$ | −1.8 | 4.8 | −17.1 | 5.6 | −34.8 | 6.0 |
| 13 | 1.2/1.0 | $5.0 \times 10^{11}$ | −1.9 | 5.6 | −14.4 | 5.8 | −25.6 | 5.7 |
| 14 | 0.6/1.0 | $1.3 \times 10^{11}$ | −1.4 | 4.3 | −20.8 | 6.0 | −32.7 | 6.2 |
| 15 | 0.6/2.0 | $7.0 \times 10^{11}$ | −2.1 | 4.1 | −21.1 | 6.2 | −29.3 | 6.0 |

TABLE IV

Examples 16–19 - Data For Various $GeO_2/B_2O_3$ Coatings Fired @ 900° C.

| Example No. | $GeO_2/B_2O_3$ (pph) | Resistivity (ohm-cm) | Fresh g/m | Fresh TC | 2 min BB g/m | 2 min BB TC | 10 min BB g/m | 10 min BB TC |
|---|---|---|---|---|---|---|---|---|
| 16 | 1.2/0.5 | $2.4 \times 10^{8}$ | −80.7 | 4.4 | −65.7 | 5.9 | −62.8 | 5.6 |
| 17 | 1.2/1.0 | $7.1 \times 10^{8}$ | −74.7 | 5.0 | −72.7 | 5.4 | −62.7 | 5.4 |
| 18 | 0.6/1.0 | $5.7 \times 10^{8}$ | −79.2 | 4.6 | −74.4 | 5.3 | −59.3 | 5.3 |
| 19 | 0.6/2.0 | $1.6 \times 10^{8}$ | −81.9 | 3.0 | −66.5 | 5.3 | −62.6 | 5.2 |

As can be seen from Tables III and IV, the drop in resistivity occurs between 600–900° C. as also seen in Table I for Examples 1–7; however, the overall increase in conductivity is not as large as for the $GeO_2$ coating in Examples 1–7 and suggests more robust processing conditions.

For Examples 16–19, the development efficiency and I-CPU are evaluated according to the procedures substantially as described in Examples 1–7. The data obtained are shown in Table V, and an improvement in I-CPU is illustrated.

TABLE V

Examples 16–19 - Development Performance Data

| Example No. | $GeO_2/B_2O_3$ Content (pph) | Resistivity (ohm-cm) | Rel DE* | I-CPU |
|---|---|---|---|---|
| 16 | 1.2/0.5 | $2.4 \times 10^{8}$ | 1.65 | V. Weak (1) |
| 17 | 1.2/1.0 | $7.1 \times 10^{8}$ | 1.15 | None (0) |
| 18 | 0.6/1.0 | $5.7 \times 10^{8}$ | 1.32 | None (0) |
| 19 | 0.6/2.0 | $1.6 \times 10^{8}$ | 1.53 | None (0) |

*Relative to a control carrier without the coating and the same toner composition.

EXAMPLES 20–31

Strontium Ferrite Carriers Coated With Mixed $GeO_2/Li_2O$ Composition

For Examples 20–31, a commercially-prepared $SrFe_{12}O_{19}$ hard ferrite carrier is coated with a mixed $GeO_2/Li_2O$ composition according to the present invention by using two different sources for the $Li_2O$ component. The coated carriers are prepared using generally the procedures as described in Examples 1–7 above, except as provided hereinbelow.

For Example 20, a slurry of the ferrite particles is made by placing a 50 gram (g) amount of the $SrFe_{12}O_{19}$ ferrite particles into a glass dish, along with 20 ml of an ammonium germanate-lithium acetate solution. The ammonium germanate-lithium acetate solution is made by adding 0.05 g of lithium acetate (98% grade available from Aldrich Company of St. Louis, Mo.) to 11.7 ml of distilled water and combining the resulting solution with 8.3 ml of the ammonium germanate solution made as in Examples 1–7. The procedure of Examples 1–7 is substantially repeated at a furnace temperature of 600° C. to yield a carrier with a mixed $GeO_2/Li_2O$ oxide composition deposited thereon having the stoichiometry of 1.0 pph $GeO_2$ (0.99 wt % based on total weight of the carrier) and 0.015 pph $Li_2O$ (0.015 wt %)

For Example 21, a slurry of the ferrite particles is made by placing a 50 gram (g) amount of the $SrFe_{12}O_{19}$ ferrite particles into a glass dish, along with 20 ml of an ammonium germanate-lithium acetate solution. The ammonium germanate-lithium acetate solution is made by adding 0.1 g of the lithium acetate used in Example 20 above into 11.7 ml of distilled water and combining the resulting solution with 8.3 ml of the ammonium germanate solution made as in Examples 1–7. The procedure of Example 20 is substantially repeated to yield a carrier having a mixed $GeO_2/Li_2O$ oxide composition deposited thereon having the stoichiometry of 1.0 pph $GeO_2$ and 0.029 pph $Li_2O$.

For Example 22, a slurry of the ferrite particles is made by placing a 50 gram (g) amount of the $SrFe_{12}O_{19}$ ferrite particles into a glass dish, along with 20 ml of an ammonium germanate-lithium acetate solution. The ammonium germanate-lithium acetate solution is made by adding 0.15 g of the lithium acetate used in Example 20 above to 11.7 ml of distilled water and combining the resulting solution with 8.3 ml of the ammonium germanate solution made as in Examples 1–7. The procedure of Example 20 is substantially repeated to yield a carrier having a mixed $GeO_2/Li_2O$ oxide composition deposited thereon having the stoichiometry of 1.0 pph $GeO_2$ and 0.044 pph $Li_2O$.

For Examples 23–25, the procedures for Examples 20–22 respectively are substantially repeated, except the furnace temperature is 900° C. in each instance.

For Example 26, a slurry of the ferrite particles is made by placing a 50 gram (g) amount of the $SrFe_{12}O_{19}$ ferrite particles into a glass dish, along with 20 ml of an ammonium germanate-lithium nitrate solution. The ammonium germanate-lithium nitrate solution is made by adding 0.034 g of lithium nitrate (99.999% grade available from Aldrich Company of St. Louis, Mo.) in 11.7 ml of distilled water and combining the resulting solution with 8.3 ml of the ammonium germanate solution made as in Examples 1–7. The procedure of Examples 1–7 is substantially repeated at a furnace temperature of 600° C. to yield a carrier having a mixed $GeO_2/Li_2O$ oxide composition deposited thereon having the stoichiometry of 1.0 pph $GeO_2$ and 0.015 pph $Li_2O$ For Example 27, a slurry of the ferrite particles is made by placing a 50 gram (g) amount of the $SrFe_{12}O_{19}$ ferrite particles into a glass dish, along with 20 ml of an ammonium germanate-lithium nitrate solution. The ammonium germanate-lithium nitrate solution is made by adding 0.069 g of the lithium nitrate used in Example 26 above into 11.7 ml of distilled water and combining the resulting solution with 8.3 ml of the ammonium germanate solution made as in Examples 1–7. The procedure of Example 26 is substantially repeated to yield a carrier having a mixed $GeO_2/Li_2O$ oxide composition deposited thereon having the stoichiometry of 1.0 pph $GeO_2$ and 0.030 pph $Li_2O$.

For Example 28, a slurry of the ferrite particles is made by placing a 50 gram (g) amount of the $SrFe_{12}O_{19}$ ferrite particles into a glass dish, along with 20 ml of an ammonium germanate-lithium nitrate solution. The ammonium germanate-lithium nitrate solution is made by adding 0.101 g of the lithium nitrate used in Example 26 above into 11.7 ml of distilled water and combining the resulting solution with 8.3 ml of the ammonium germanate solution made as in Examples 1–7. The procedure of Example 26 is substantially repeated to yield a carrier having a mixed $GeO_2/Li_2O$ oxide composition deposited thereon having the stoichiometry of 1.0 pph $GeO_2$ and 0.044 pph $Li_2O$.

For Examples 29–31, the procedures for Examples 26–28 respectively are substantially repeated, except the furnace temperature is 900° C. in each instance.

The resistivities measured for each resulting carrier in Examples 20–31 are shown in Table VI below.

TABLE VI $GeO_2/Li_2O$ Coatings - Resistivity Data

| Example No. | $Li_2O$ source | Composition $GeO_2/Li_2O$ (pph) | Firing Temp. (° C.) | resistivity (ohm-cm) |
|---|---|---|---|---|
| 20 | $LiCH_3COO2H_2O$ | 1.0/0.015 | 600 | $9.9 \times 10^8$ |
| 21 | " | 1.0/0.029 | " | $7.4 \times 10^8$ |
| 22 | " | 1.0/0.044 | " | $7.5 \times 10^8$ |
| 23 | " | 1.0/0.015 | 900 | $2.2 \times 10^5$ |
| 24 | " | 1.0/0.029 | " | $6.9 \times 10^5$ |
| 25 | " | 1.0/0.044 | " | $1.0 \times 10^7$ |
| 26 | $LiNO_3$ | 1.0/0.015 | 600 | $2.7 \times 10^8$ |
| 27 | " | 1.0/0.030 | " | $4.3 \times 10^8$ |
| 28 | " | 1.0/0.044 | " | $3.1 \times 10^8$ |
| 29 | " | 1.0/0.015 | 900 | $2.6 \times 10^5$ |
| 30 | " | 1.0/0.030 | " | $4.6 \times 10^6$ |
| 31 | " | 1.0/0.044 | " | $3.8 \times 10^8$ |

For Examples, 20–22 and 24–25, the resulting carriers are also used to prepare a two-component developer using the yellow polyester toner using the procedure substantially as described in Examples 1–7. For each example, the charge-to-mass ratio (q/m) in microcoulombs per gram ($\mu$C/g) and toner concentration (TC) in weight percent (wt %) are measured as in Examples 1–7, and the values obtained are also shown in Table VII.

TABLE VII

Examples 20–22 and 24–25 - Performance Data For Various $GeO_2/Li_2O$ Coatings

| Example No. | $GeO_2/Li_2O$ (pph) | Resistivity (ohm-cm) | 10 min BB g/m | TC | Rel DE* | I-CPU |
|---|---|---|---|---|---|---|
| | | Fired @ 600° C. | | | | |
| 20 | 1.0/0.015 | $9.9 \times 10^8$ | −18.5 | 6.1 | 1.83 | None (0) |
| 21 | 1.0/0.029 | $7.4 \times 10^8$ | −15.6 | 6.3 | 1.69 | None (0) |
| 22 | 1.0/0.044 | $7.5 \times 10^8$ | −21.4 | 6.2 | 1.77 | None (0) |
| | | Fired @ 900° C. | | | | |
| 24 | 1.0/0.029 | $6.9 \times 10^5$ | −52.5 | 6.0 | 2.04 | Weak–Moderate (3) |
| 25 | 1.0/0.044 | $1.0 \times 10^7$ | −39.7 | 6.0 | 2.25 | Weak–Moderate (3) |

*Relative to a control carrier without the coating and the same toner composition. [001b]

EXAMPLES 32–43

Strontium Ferrite Carriers Coated With Mixed $GeO_2/Na_2O$ Composition

For Examples 32–43, a commercially-prepared $SrFe_{12}O_{19}$ hard ferrite carrier is coated with a mixed $GeO_2/Na_2O$ composition according to the present invention by using two different sources for the $Na_2O$ component. The coated carriers are prepared using generally the procedures as described in Examples 1–7 above, except as provided hereinbelow.

For Example 32, a slurry of the ferrite particles is made by placing a 50 g amount of the $SrFe_{12}O_{19}$ ferrite particles into a glass dish, along with 20 ml of an ammonium germanate-sodium acetate solution. The ammonium germanate-sodium acetate solution is made by adding 0.05 g of sodium acetate (obtained from Aldrich Company of St. Louis, Mo.) to 11.7 ml of distilled water and combining the resulting solution with 8.3 ml of the ammonium germanate solution made as in Examples 1–7. The procedure of Examples 1–7 is substantially repeated at a furnace temperature of 600° C. to yield a carrier having a mixed $GeO_2/Na_2O$ oxide composition deposited thereon having the stoichiometry of 1.0 pph $GeO_2$ (0.99 wt % based on total weight of the carrier) and 0.023 pph $Na_2O$ (0.023 wt %).

For Example 33, a slurry of the ferrite particles is made by placing a 50 gram g amount of the $SrFe_{12}O_{19}$ ferrite particles into a glass dish, along with 20 ml of an ammonium germanate-sodium acetate solution. The ammonium germanate-sodium acetate solution is made by adding 0.10 g of the sodium acetate used in Example 32 above to 11.7 ml of distilled water and combining the resulting solution with 8.3 ml of the ammonium germanate solution made as in Examples 1–7. The procedure of Example 32 is substantially repeated to yield a carrier having a mixed $GeO_2/Na_2O$ oxide composition deposited thereon having the stoichiometry of 1.0 pph $GeO_2$ and 0.046 pph $Na_2O$.

For Example 34, a slurry of the ferrite particles is made by placing a 50 gram g amount of the $SrFe_{12}O_{19}$ ferrite particles into a glass dish, along with 20 ml of an ammonium germanate-sodium acetate solution. The ammonium germanate-sodium acetate solution is made by adding 0.15 g of the sodium acetate used in Example 32 above into 11.7 ml of distilled water and combining the resulting solution with 8.3 ml of the ammonium germanate solution made as in Examples 1–7. The procedure of Example 32 is substantially repeated to yield a carrier having a mixed $GeO_2/Na_2O$ oxide composition deposited thereon having the stoichiometry of 1.0 pph $GeO_2$ and 0.068 pph $Na_2O$.

For Examples 35–37, the procedures for Examples 32–34 respectively are substantially repeated, except the furnace temperature is 900° C. in each instance.

For Example 38, a slurry of the ferrite particles is made by placing a 50 g amount of the $SrFe_{12}O_{19}$ ferrite particles into a glass dish, along with 20 ml of an ammonium germanate-sodium nitrate solution. The ammonium germanate-sodium nitrate solution is made by adding 0.031 g of sodium nitrate (obtained from Aldrich Company of St. Louis, Mo.) to 11.7 ml of distilled water and combining the resulting solution with 8.3 ml of the ammonium germanate solution made as in Examples 1–7. The procedure of Examples 1–7 is substantially repeated at a furnace temperature of 600° C. to yield a carrier having a mixed $GeO_2/Na_2O$ oxide composition deposited thereon having the stoichiometry of 1.0 pph $GeO_2$ and 0.023 pph $Na_2O$.

For Example 39, a slurry of the ferrite particles is made by placing a 50 gram (g) amount of the $SrFe_{12}O_{19}$ ferrite particles into a glass dish, along with 20 ml of an ammonium germanate-sodium nitrate solution. The ammonium germanate-sodium nitrate solution is made by adding 0.062 g of the sodium nitrate used in Example 38 above into 11.7 ml of distilled water and combining the resulting solution with 8.3 ml of the ammonium germanate solution made as in Examples 1–7. The procedure of Example 38 is substantially repeated to yield a carrier having a mixed $GeO_2/Na_2O$ oxide composition deposited thereon having the stoichiometry of 1.0 pph $GeO_2$ and 0.046 pph $Na_2O$.

For Example 40, a slurry of the ferrite particles is made by placing a 50 gram (g) amount of the $SrFe_{12}O_{19}$ ferrite particles into a glass dish, along with 20 ml of an ammonium germanate-sodium nitrate solution. The ammonium germanate-sodium nitrate solution is made by adding 0.094 g of the sodium nitrate used in Example 38 above into 11.7 ml of distilled water and combining the resulting solution with 8.3 ml of the ammonium germanate solution made as in Examples 1–7. The procedure of Example 38 is substantially repeated to yield a carrier having a mixed $GeO_2/Na_2O$ oxide composition deposited thereon having the stoichiometry of 1.0 pph $GeO_2$ and 0.068 pph $Na_2O$.

For Examples 41–43, the procedures for Examples 38–40 respectively are substantially repeated, except the furnace temperature is 900° C. in each instance.

The resistivities measured for each resulting carrier in Examples 32–43 are shown in Table VIII below.

TABLE VIII $GeO_2/Na_2O$ Coatings - Resistivity Data

| Example No. | $Na_2O$ source | Composition $GeO_2/Na_2O$ (pph) | Firing Temp. (° C.) | resistivity (ohm-cm) |
|---|---|---|---|---|
| 32 | $NaCH_3COO3H_2O$ | 1.0/0.023 | 600 | $5.0 \times 10^8$ |
| 33 | " | 1.0/0.046 | " | $2.0 \times 10^8$ |
| 34 | " | 1.0/0.068 | " | $9.7 \times 10^8$ |
| 35 | " | 1.0/0.023 | 900 | $1.0 \times 10^8$ |
| 36 | " | 1.0/0.046 | " | $1.1 \times 10^6$ |
| 37 | " | 1.0/0.068 | " | $3.4 \times 10^6$ |
| 38 | $NaNO_3$ | 1.0/0.023 | 600 | $4.7 \times 10^8$ |
| 39 | " | 1.0/0.046 | " | $3.2 \times 10^8$ |
| 40 | " | 1.0/0.068 | " | $1.7 \times 10^8$ |
| 41 | " | 1.0/0.023 | 900 | $2.8 \times 10^5$ |
| 42 | " | 1.0/0.046 | " | $3.6 \times 10^6$ |
| 43 | " | 1.0/0.068 | " | $2.0 \times 10^6$ |

In Examples 32–34, the resulting carriers are also used to prepare a two-component developer using the yellow polyester toner using the procedure substantially as described in Examples 1–7. For each example, the charge-to-mass ratio (q/m) in microcoulombs per gram ($\mu$C/g) and toner concentration (TC) in weight percent (wt %) are measured as in Examples 1–7, and the values obtained are also shown in Table IX.

TABLE IX

Examples 32–34 - Data For Various $GeO_2/Na_2O$ Coatings Fired @ 600° C.

| Example No. | $GeO_2/Na_2O$ (pph) | Resistivity (ohm-cm) | 10 min BB g/m | TC | Rel DE* | I-CPU |
|---|---|---|---|---|---|---|
| 32 | 1.0/0.023 | $5.0 \times 10^8$ | −33.0 | 6.0 | 1.83 | None (0) |
| 33 | 1.0/0.046 | $2.0 \times 10^8$ | −30.6 | 6.4 | 1.72 | None (0) |
| 34 | 1.0/0.068 | $9.7 \times 10^8$ | −31.1 | 5.5 | 2.07 | None (0) |

*Relative to a control carrier without the coating and the same toner composition.

EXAMPLES 44–53

Strontium Ferrite Carriers With $TiO_2$ Compositions

For Examples 44–53, a commercially-prepared $SrFe_{12}O_{19}$ hard ferrite carrier is coated with a $TiO_2$ composition according to the present invention. The carriers are prepared using generally the procedures as described in Examples 1–7 above, except as provided hereinbelow.

For Example 44, a slurry of the ferrite particles is made by placing a 100 g amount of the $SrFe_{12}O_{19}$ ferrite particles into a glass dish, along with 35 ml of a methanolic tetrabutylorthotitanate solution. The methanolic tetrabutylorthotitanate solution is made by dissolving 1.065 g of tetrabutylorthotitanate (obtained from Eastman Kodak Company of Rochester, N.Y.) into 35 ml of methanol. The procedure of Examples 1–7 is substantially repeated at a furnace temperature of 600° C. to yield a carrier coated with 0.25 pph (0.25 wt % based on total weight of the carrier) of $TiO_2$.

For Example 45, a slurry of the ferrite particles is made by placing a 100 g amount of the $SrFe_{12}O_{19}$ ferrite particles into a glass dish, along with 35 ml of a methanolic tetrabutylorthotitanate solution. The methanolic tetrabutylorthotitanate solution is made by dissolving 2.13 g of the tetrabutylorthotitanate into 35 ml of methanol. The procedure of Examples 1–7 is substantially repeated at a furnace temperature of 600° C. to yield a carrier coated with 0.50 pph of $TiO_2$.

For Example 46, a slurry of the ferrite particles is made by placing a 100 g amount of the $SrFe_{12}O_{19}$ ferrite particles into a glass dish, along with 35 ml of a methanolic tetrabutylorthotitanate solution. The methanolic tetrabutylorthotitanate solution is made by dissolving 4.26 g of the tetrabutylorthotitanate into 35 ml of methanol. The procedure of Examples 1–7 is substantially repeated at a furnace temperature of 600° C. to yield a carrier coated with 1.0 pph of $TiO_2$.

For Example 47, a slurry of the ferrite particles is made by placing a 100 g amount of the $SrFe_{12}O_{19}$ ferrite particles into a glass dish, along with 35 ml of a methanolic tetrabutylorthotitanate solution. The methanolic tetrabutylorthotitanate solution is made by dissolving 6.39 g of the tetrabutylorthotitanate into 35 ml of methanol. The procedure of Examples 1–7 is substantially repeated at a furnace temperature of 600° C. to yield a carrier coated with 1.5 pph of $TiO_2$.

For Example 48, a slurry of the ferrite particles is made by placing a 100 g amount of the $SrFe_{12}O_{19}$ ferrite particles into a glass dish, along with 35 ml of a methanolic tetrabutylorthotitanate solution. The methanolic tetrabutylorthotitanate solution is made by dissolving 8.52 g of the tetrabutylorthotitanate into 35 ml of methanol. The procedure of Examples 1–7 is substantially repeated at a furnace temperature of 600° C. to yield a carrier coated with 2.0 pph of $TiO_2$.

For Examples 49–53, the procedures of Examples 44–48 respectively are substantially repeated, except the furnace temperature is 900° C. in each instance.

The resistivities measured for each resulting carrier are shown in Tables X and XI below.

For Examples 44–53, the resulting carriers are used to prepare a two-component developer with the yellow polyester toner using the procedure substantially as described in Examples 1–7. For each example, the charge-to-mass ratio (q/m) in microcoulombs per gram ($\mu$C/g) and toner concentration (TC) in weight percent (wt %) are measured as in Examples 1–7, and the values obtained are also shown in Tables X and XI. Relative DE and I-CPU are also evaluated as in Examples 1–7.

TABLE X

Examples 44–48 - Data For Various $TiO_2$ Compositions Fired @ 600° C.

| Example No. | $TiO_2$ (pph) | Resistivity (ohm-cm) | 10 min BB g/m | TC | Rel DE* | I-CPU |
|---|---|---|---|---|---|---|
| 44 | 0.25 | $1.8 \times 10^9$ | −45.6 | 6.4 | 1.42 | None (0) |
| 45 | 0.5 | $1.7 \times 10^9$ | −37.7 | 6.0 | 1.40 | None (0) |
| 46 | 1.0 | $2.2 \times 10^9$ | −41.9 | 6.3 | 1.03 | None (0) |
| 47 | 1.5 | $1.9 \times 10^9$ | −29.7 | 6.3 | 1.08 | None (0) |
| 48 | 2.0 | $2.3 \times 10^9$ | −32.0 | 6.4 | 1.60 | None (0) |

*Relative to a control carrier without the coating and the same toner composition.

TABLE XI

Examples 49–53 - Data For Various $TiO_2$ Compositions Fired @ 900° C.

| Example No. | $TiO_2$ (pph) | Resistivity (ohm-cm) | 10 min BB g/m | TC | Rel DE* | I-CPU |
|---|---|---|---|---|---|---|
| 49 | 0.25 | $1.0 \times 10^7$ | −55.6 | 6.0 | 2.36 | Weak (2) |
| 50 | 0.5 | $7.8 \times 10^6$ | −51.4 | 6.3 | 3.44 | Weak (2) |
| 51 | 1.0 | $2.8 \times 10^7$ | −43.0 | 6.4 | 2.28 | Very Weak (1) |
| 52 | 1.5 | $9.3 \times 10^7$ | −41.6 | 6.2 | 2.92 | Very Weak (1) |
| 53 | 2.0 | $2.4 \times 10^8$ | −34.2 | 6.2 | 2.31 | None (0) |

*Relative to a control carrier without the coating and the same toner composition.

EXAMPLES 54–55

Strontium Ferrite Carriers With $TiO_2$ Coatings

For Examples 54–55, a commercially-prepared $SrFe_{12}O_{19}$ hard ferrite carrier is coated with a $TiO_2$ composition according to the present invention using a different source for the $TiO_2$ relative to Examples 44–53 above. The carriers are prepared using generally the procedures as described in Examples 1–7 above, except as provided hereinbelow.

For Example 54, a slurry of the ferrite particles is made by placing a 50 g amount of the $SrFe_{12}O_{19}$ ferrite particles into a glass dish, along with 20 ml of an ammonium titanyl oxalate solution. The ammonium titanyl oxalate solution is made by dissolving 1.84 g of titanyl oxalate (obtained from Johnson Matthey, Inc. of Boston, Mass.) into 20 ml of distilled water. The procedure of Examples 1–7 is substantially repeated at a furnace temperature of 600° C. to yield a carrier coated with 1.0 pph of $TiO_2$.

For Example 55, the procedure of Example 54 is substantially repeated, except that a furnace temperature of 900° C. is used to yield a carrier coated with 1.0 pph of $TiO_2$.

The resistivities measured for each resulting carrier are shown in Tables XII below.

For Examples 54–55, the resulting carriers are also used to prepare a two-component developer with the yellow polyester toner using the procedure substantially as described in Examples 1–7. For each example, the charge-to-mass ratio (q/m) in microcoulombs per gram ($\mu$C/g) and toner concentration (TC) in weight percent (wt %) as in Examples 1–7, and the values obtained are also shown in Table XII.

TABLE XII

Examples 54–55 - Data for $TiO_2$ Compositions Prepared with Titanyl Oxalate

| Example No. | $TiO_2$ (pph) | Temp (° C.) | Resistivity (ohm-cm) | Fresh g/m | Fresh TC | 2 min BB g/m | 2 min BB TC | 10 min BB g/m | 10 min BB TC |
|---|---|---|---|---|---|---|---|---|---|
| 54 | 1.0 | 600 | $4.2 \times 10^8$ | −52.5 | 5.9 | −56.0 | 5.7 | −49.2 | 5.9 |
| 55 | 1.0 | 900 | $4.9 \times 10^6$ | −65.6 | 5.9 | −57.3 | 6.2 | −51.6 | 6.1 |

EXAMPLES 56–61

Strontium Ferrite Carriers With $ZrO_2$ Coatings

For Examples 56–61, a commercially-prepared $SrFe_{12}O_{19}$ hard ferrite carrier is coated with a $ZrO_2$ composition according to the present invention. The carriers are prepared using generally the procedures as described in Examples 1–7 above, except as provided hereinbelow.

For Example 56, a slurry of the ferrite particles is made by placing a 100 g amount of the $SrFe_{12}O_{19}$ ferrite particles into a glass dish, along with 35 ml of an aqueous, colloidal zirconium acetate solution (NYACOL dispersion—20% $ZrO_2$ content obtained from The PQ Corporation of Ashland, Mass.) The zirconium acetate solution is made by combining 2.5 g of the zirconium acetate dispersion with an amount of distilled water sufficient to make up 35 ml of solution. The procedure of Examples 1–7 is substantially repeated at a furnace temperature of 900° C. to yield a carrier coated with 0.5 pph of $ZrO_2$.

For Example 57, a slurry of the ferrite particles is made by placing a 100 g amount of the $SrFe_{12}O_{19}$ ferrite particles into a glass dish, along with 35 ml of an aqueous zirconium acetate solution prepared by combining 5.0 g of the zirconium acetate dispersion with distilled water. The procedure of Examples 1–7 is substantially repeated at a furnace temperature of 900° C. to yield a carrier coated with 1.0 pph of $ZrO_2$.

For Example 58, a slurry of the ferrite particles is made by placing a 100 g amount of the $SrFe_{12}O_{19}$ ferrite particles into a glass dish, along with 35 ml of the aqueous zirconium acetate solution prepared by combining 10 g of the zirconium acetate dispersion with of distilled water. The procedure of Examples 1–7 is substantially repeated at a furnace temperature of 900° C. to yield a carrier coated with 2.0 pph of $ZrO_2$.

For Examples 59–61, the procedures of Examples 56–58 respectively are substantially repeated, except the furnace temperature is 1150° C. in each instance.

The resistivities measured for each resulting carrier are shown in Tables XIII and XIV below.

For Examples 56–61, the resulting carriers are used to prepare a two-component developer with the yellow polyester toner using the procedure substantially as described in Examples 1–7. For each example, the charge-to-mass ratio (q/m) in microcoulombs per gram ($\mu$C/g) and toner concentration (TC) in weight percent (wt %) as in Examples 1–7, and the values obtained are also shown in Tables XIII and XIV. Relative DE and I-CPU are also evaluated as in Examples 1–7, except that the numerical scale is assigned to various levels of I-CPU deposition as in Examples 44–53.

TABLE XIII

Examples 56–58 - Data For Various $ZrO_2$ Coatings Fired @ 900° C.

| Example No. | $ZrO_2$ (pph) | Resistivity (ohm-cm) | 10 min BB g/m | TC | Rel DE* | I-CPU |
|---|---|---|---|---|---|---|
| 56 | 0.5 | $1.2 \times 10^{10}$ | −59.3 | 5.9 | 1.14 | None (0) |
| 57 | 1.0 | $5.3 \times 10^{9}$ | −48.7 | 6.0 | 1.14 | None (0) |
| 58 | 2.0 | $2.8 \times 10^{9}$ | −46.0 | 6.0 | 1.20 | None (0) |

*Relative to a control carrier without the coating and the same toner composition.

TABLE XIV

Examples 59–61 - Data For Various $ZrO_2$ Coatings Fired @ 1150° C.

| Example No. | $TiO_2$ (pph) | Resistivity (ohm-cm) | 10 min BB g/m | TC | Rel DE* | I-CPU |
|---|---|---|---|---|---|---|
| 56 | 0.5 | $2.2 \times 10^{7}$ | −33.3 | 6.3 | 1.52 | Weak (2) |
| 60 | 1.0 | — | −45.8 | 6.0 | 1.72 | Weak (2) |
| 61 | 2.0 | $8.7 \times 10^{7}$ | −50.5 | 6.0 | 1.56 | Weak (2) |

*Relative to a control carrier without the coating and the same toner composition.
"—" means not measured.

EXAMPLES 62–70

Strontium Ferrite Carriers With $SnO_2$ Coatings

For Examples 62–70, a commercially-prepared $SrFe_{12}O_{19}$ hard ferrite carrier is coated with a $SnO_2$ composition according to the present invention. The carriers are prepared using generally the procedures as described in Examples 1–7 above, except as provided hereinbelow.

For Example 62, a slurry of the ferrite particles is made by placing a 100 g amount of the $SrFe_{12}O_{19}$ ferrite particles into a glass dish, along with 35 ml of an aqueous, colloidal tin oxide solution. The aqueous tin oxide solution is made by combining 3.33 g of a colloidal tin oxide dispersion (NYACOL dispersion obtained from The PQ Corporation of Ashland, Mass.) with an amount of distilled water sufficient to make up 35 ml of solution. The procedure of Examples 1–7 is substantially repeated at a furnace temperature of 600° C. to yield a carrier having 0.5 pph of $SnO_2$ deposited thereon.

For Example 63, a slurry of the ferrite particles is made by placing a 100 g amount of the $SrFe_{12}O_{19}$ ferrite particles into a glass dish, along with 35 ml of an aqueous tin oxide solution prepared by combining 6.67 g of the colloidal tin oxide dispersion with distilled water. The procedure of Examples 1–7 is substantially repeated at a furnace temperature of 600° C. to yield a carrier coated with 1.0 pph of $SnO_2$.

For Example 64, a slurry of the ferrite particles is made by placing a 100 g amount of the $SrFe_{12}O_{19}$ ferrite particles into a glass dish, along with 35 ml of an aqueous tin oxide solution prepared by combining 13.34 g of the colloidal tin oxide dispersion with distilled water. The procedure of Examples 1–7 is substantially repeated at a furnace temperature of 600° C. to yield a carrier coated with 2.0 pph of $SnO_2$.

For Examples 65–67, the procedures of Examples 62–64 respectively are substantially repeated, except the furnace temperature is 750° C. in each instance.

For Examples 68–70, the procedures of Examples 62–64 respectively are substantially repeated, except the furnace temperature is 900° C. in each instance.

The resistivities measured for each resulting carrier are shown in Table XV below.

For Examples 62–64 and 68–70, the resulting carriers are used to prepare a two-component developer with the yellow polyester toner using the procedure substantially as described in Examples 1–7. For each example, the charge-to-mass ratio (q/m) in microcoulombs per gram ($\mu$C/g) and toner concentration (TC) in weight percent (wt %) are measured as in Examples 1–7, and the values obtained are also shown in Table XV. For Examples 68–70, Relative DE and I-CPU are also evaluated as in Examples 1–7, except that a numerical scale is assigned to various levels of I-CPU deposition as in Examples 44–53.

TABLE XV

Examples 62–70 - Data For Carriers with $SnO_2$ Coatings

| Exam. No. | $SnO_2$ (pph) | Fire Temp (° C.) | Resistivity (ohm-cm) | Fresh g/m | Fresh TC | 2 min BB g/m | 2 min BB TC | 10 min BB g/m | 10 min BB TC | Rel DE | I-CPU |
|---|---|---|---|---|---|---|---|---|---|---|---|
| 62 | 0.5 | 600 | $2.6 \times 10^{9}$ | −32.2 | 6.2 | −41.8 | 6.1 | −42.7 | 6.0 | — | — |
| 63 | 1.0 | 600 | $2.4 \times 10^{9}$ | −36.0 | 6.0 | −38.9 | 6.1 | −34.3 | 5.9 | — | — |
| 64 | 2.0 | 600 | $1.1 \times 10^{9}$ | −28.9 | 6.0 | −32.4 | 5.9 | −32.2 | 6.0 | — | — |
| 65 | 0.5 | 750 | $1.2 \times 10^{9}$ | — | | | — | | — | — | — |
| 66 | 1.0 | 750 | $6.7 \times 10^{8}$ | — | | | — | | — | — | — |
| 67 | 2.0 | 750 | $6.4 \times 10^{8}$ | — | | | — | | — | — | — |
| 68 | 0.5 | 900 | $7.1 \times 10^{8}$ | −50.0 | 6.0 | −57.4 | 5.9 | −53.4 | 5.7 | 1.79 | None (0) |
| 69 | 1.0 | 900 | $1.2 \times 10^{8}$ | −44.2 | 6.0 | −48.4 | 6.1 | −49.5 | 5.9 | 2.08 | V. Weak (1) |
| 70 | 2.0 | 900 | $1.2 \times 10^{8}$ | −37.0 | 6.2 | −32.7 | 6.2 | −40.5 | 6.1 | 1.53 | V. Weak (1) |

*Relative to a control carrier without the coating and the same toner composition.
"—" means not measured.

Barium and lead containing ferrites commonly referred to as magnetoplumbite ferrites which are substituted with multi-valent metal ions as described hereinabove are expected to achieve similar results when used as electrographic carrier materials.

"Electrography" and "electrographic" as used herein are broad terms that include image forming processes involving the development of an electrostatic charge pattern formed on a surface with or without light exposure, and thus includes electrophotography and other similar processes.

Although the invention has been described in considerable detail, and with particular reference to preferred embodiments, it should be understood that variations and modifications to such embodiments can be made within the scope of the invention.

What is claimed is:

1. Carrier for use in the development of electrostatic latent images, the carrier comprising a core of a hard magnetic material having an outer surface with a conductive metal oxide composition disposed on the outer surface of the core, the metal oxide composition comprising an oxide of at least one metal.

2. The carrier of claim 1, wherein the hard magnetic material is a hard magnetic ferrite with a single-phase, hexagonal crystal structure.

3. The carrier of claim 2 wherein the hard magnetic ferrite is strontium ferrite, barium ferrite or lead ferrite.

4. The carrier of claim 1 wherein the metal oxide composition is selected from the group consisting of germanium oxide, zirconium oxide, titanium oxide, tin oxide, and mixtures thereof, and optionally, a second metal oxide selected from the group consisting of boron oxide, lithium oxide, and sodium oxide.

5. The carrier of claim 4 wherein the metal oxide composition is present in an amount of from about 0.01 to about 3 weight percent, based on total weight of the carrier.

6. The carrier of claim 2 wherein the metal oxide composition is represented by the formula $MO_{n/2}$ wherein M is at least one multi-valent metal represented by $M^{n+}$, where n is an integer of at least 4.

7. The carrier of claim 6 wherein the outer surface of the core defines a transition zone which extends from the outer surface into the core of the hard magnetic ferrite material, the single-phase hexagonal crystal structure of the hard magnetic ferrite material within the transition zone being doped with ions of the at least one multi-valent metal ion of formula $M^{n+}$.

8. The carrier of claim 7 wherein n is 4 or 5.

9. The carrier of claim 7 wherein n is 4.

10. The carrier of claim 7 wherein M is selected from the group consisting of antimony, arsenic, germanium, hafnium, molybdenum, niobium, silicon, tantalum, tellurium, tin, titanium, tungsten, vanadium, zirconium, and mixtures thereof.

11. The carrier of claim 7 wherein M is selected from the group consisting of silicon, zirconium, tin, titanium, and mixtures thereof.

12. The carrier of claim 7 wherein the metal oxide composition further comprises an alkali metal oxide.

13. The carrier of claim 12 wherein the alkali metal is selected from the group consisting of lithium, potassium, and sodium.

14. The carrier of claim 12 wherein the alkali metal oxide is present in an amount of from about 0.01 to about 1 weight percent based on total weight of the carrier.

15. The carrier of claim 1 which further comprises a resin layer of at least one polymer resin disposed on the metal oxide layer.

16. The carrier of claim 15 wherein the resin layer is discontinuous.

17. The carrier of claim 15 wherein the at least one polymer resin is a mixture of polyvinylidene fluoride and polymethylmethacrylate.

18. The carrier of claim 15 wherein the at least one polymer resin is a silicone resin.

19. The carrier of claim 1 having a resistivity of from about $1\times10^{10}$ to about $1\times10^{5}$ ohm-cm.

20. Carrier for use in the development of electrostatic latent images, the carrier comprising a core of a hard magnetic ferrite material having a single-phase, hexagonal crystal structure, the core having an outer surface with a metal oxide composition disposed thereon represented by the formula $MO_{n/2}$ wherein M is at least one multi-valent metal represented by $M^{n+}$ with n being an integer of at least 4, the outer surface further defining a transition zone which extends from the outer surface and into the core of the hard magnetic ferrite material where the single-phase hexagonal crystal structure within the transition zone is doped with ions of the at least one multi-valent metal ion of formula $M^{n+}$.

21. The carrier of claim 20 wherein the hard magnetic ferrite material is strontium ferrite, barium ferrite or lead ferrite.

22. The carrier of claim 20 wherein the hard magnetic ferrite material is strontium ferrite.

23. The carrier of claim 20 wherein the metal oxide composition is selected from the group consisting of germanium oxide, zirconium oxide, titanium oxide, tin oxide, and mixtures thereof, and optionally, a second metal oxide selected from the group consisting of boron oxide, lithium oxide, and sodium oxide.

24. The carrier of claim 20 wherein the metal oxide composition is present in an amount of from about 0.01 to about 3 weight percent, based on total weight of the carrier.

25. The carrier of claim 20 wherein n is 4 or 5.

26. The carrier of claim 20 wherein n is 4.

27. The carrier of claim 20 wherein M is selected from the group consisting of antimony, arsenic, germanium, hafnium, molybdenum, niobium, silicon, tantalum, tellurium, tin, titanium, tungsten, vanadium, zirconium, and mixtures thereof.

28. The carrier of claim 20 wherein M is selected from the group consisting of silicon, zirconium, tin, titanium, and mixtures thereof.

29. The carrier of claim 20 wherein the metal oxide composition further comprises an alkali metal oxide.

30. The carrier of claim 29 wherein the alkali metal is selected from the group consisting of lithium, potassium, and sodium.

31. The carrier of claim 29 wherein the alkali metal oxide is present in an amount of from about 0.01 to about 1 weight percent based on total weight of the carrier.

32. The carrier of claim 20 where the at least one metal oxide composition is a discontinuous layer disposed on the core.

33. The carrier of claim 20 which further comprises a resin layer of at least one polymer resin disposed on the metal oxide layer.

34. The carrier of claim 33 wherein the resin layer is discontinuous.

35. The carrier of claim 33 wherein the at least one polymer resin is a mixture of polyvinylidene fluoride and polymethylmethacrylate.

36. The carrier of claim 33 wherein the at least one polymer resin is a silicone resin.

37. The carrier of claim 20 having a resistivity of from about $1\times10^{10}$ to about $1\times10^{5}$ ohm-cm.

38. A method for developing an electrostatic image comprising contacting the image with a two-component dry developer composition comprising charged toner particles and oppositely charged carrier particles according to claim 1.

39. A method for developing an electrostatic image comprising contacting the image with a two-component dry developer composition comprising charged toner particles and oppositely charged carrier particles according to claim 20.

40. An electrostatic two-component dry developer composition for use in the development of electrostatic latent images which comprises a mixture of charged toner particles and oppositely charged particulate carrier according to claim 1.

41. An electrostatic two-component dry developer composition for use in the development of electrostatic latent images which comprises a mixture of charged toner particles and oppositely charged particulate carrier according to claim 20.

42. A method for preparing carrier particles for use in the development of electrostatic latent images, the method comprising:

providing a particulate core material comprised of particles of a hard magnetic material;

admixing the core particles with a solution comprising a solvent and at least one metal oxide precursor compound;

heating the core particles and the solution to remove solvent therefrom and coat the at least one metal oxide precursor compound onto the surface of the core particles; and firing the so-coated core particles in an oxidizing atmosphere at a temperature sufficient to form a conductive metal oxide composition on the outer surface of the core particles, the conductive metal oxide composition comprising a layer of an oxide of at least one metal.

* * * * *